US010803840B1

(12) United States Patent
Greene et al.

(10) Patent No.: US 10,803,840 B1
(45) Date of Patent: Oct. 13, 2020

(54) LINEAR DOVETAIL NECK JOINT FOR MUSICAL INSTRUMENT

(71) Applicant: Dreadnought, Inc., Wilmington, DE (US)

(72) Inventors: Frederick E. Greene, Allentown, PA (US); Timothy A. Teel, Lehighton, PA (US); Rameen J. Shayegan, Bangor, PA (US); Damian B. Walck, Lehighton, PA (US); Nathan J. Hoffman, Wind Gap, PA (US)

(73) Assignee: Dreadnought, Inc., Wilmington, DE (US)

( * ) Notice: Subject to any disclaimer, the term of this patent is extended or adjusted under 35 U.S.C. 154(b) by 0 days.

(21) Appl. No.: 16/796,010

(22) Filed: Feb. 20, 2020

Related U.S. Application Data

(60) Provisional application No. 62/864,770, filed on Jun. 21, 2019.

(51) Int. Cl.
*G10D 3/06* (2020.01)
*G10D 1/08* (2006.01)

(52) U.S. Cl.
CPC ..... *G10D 3/06* (2013.01); *G10D 1/08* (2013.01)

(58) Field of Classification Search
CPC ..... G10D 3/06; G10D 1/08
See application file for complete search history.

(56) References Cited

U.S. PATENT DOCUMENTS 3,550,496 A 12/1970 Fender
4,027,570 A 6/1977 Rendell et al.
4,207,688 A 6/1980 Derderian et al.
4,638,708 A 1/1987 Kamal
4,793,236 A 12/1988 McGuire et al.
4,803,906 A 2/1989 Fender
4,982,640 A 1/1991 Buscarino
(Continued)

FOREIGN PATENT DOCUMENTS

CN 103915082 7/2014
CN 206340330 7/2017
(Continued)

OTHER PUBLICATIONS

EKO Fastlok, "A new era for acoustic guitars", EKO Music Group Spa Press Release, 2011, pp. 1-2.
(Continued)

*Primary Examiner* — Kimberly R Lockett
(74) *Attorney, Agent, or Firm* — Stradley Ronon Stevens & Young, LLP

(57) ABSTRACT

A linear dovetail neck joint for a musical instrument having a neck, a body, and a fretboard. The linear dovetail neck joint relies on an internal dovetail with screw-adjustable tension while avoiding screws that go directly into the neck. The linear dovetail neck joint allows for extreme fret accessibility in the upper register of the fretboard (due to lack of heel on the neck), easier neck height adjustments, intonation correction, and unique front block configurations with hand relief—all without the need for adhesives. The linear dovetail neck joint permits a practical and aesthetically pleasing neck-to-body joint without the need for a heel on the neck. The result is a neck-to-body joint that is easily adjustable and serviceable.

20 Claims, 9 Drawing Sheets

(56) References Cited

U.S. PATENT DOCUMENTS

| | | | |
|---|---|---|---|
| 5,125,311 | A | 6/1992 | Boulanger et al. |
| 5,235,891 | A | 8/1993 | Klein |
| 5,305,819 | A | 4/1994 | Boulanger et al. |
| 5,458,035 | A | 10/1995 | Okamura |
| 5,511,455 | A | 4/1996 | Steinberger |
| 5,679,910 | A | 10/1997 | Steinberger |
| 5,864,073 | A | 1/1999 | Carlson |
| 5,886,272 | A | 3/1999 | Regenberg |
| 5,965,830 | A | 10/1999 | Carlson |
| 6,051,765 | A | 4/2000 | Regenberg et al. |
| 6,051,766 | A | 4/2000 | Taylor |
| 6,262,353 | B1 | 7/2001 | Murray |
| 6,265,648 | B1 | 7/2001 | Steinberger |
| 6,759,581 | B2 | 7/2004 | Taylor |
| 6,831,218 | B2 | 12/2004 | Steinberger |
| 6,888,055 | B2 | 5/2005 | Smith et al. |
| 7,157,634 | B1 | 1/2007 | Babicz |
| 7,189,907 | B1 | 3/2007 | Poulin et al. |
| 7,208,664 | B1 | 4/2007 | Regenberg et al. |
| 7,465,859 | B2 | 12/2008 | Kroeger et al. |
| 7,476,790 | B2 | 1/2009 | Breedlove et al. |
| 7,518,048 | B2 | 4/2009 | Murray |
| 7,525,030 | B2 | 4/2009 | Clark |
| 7,557,281 | B1 | 7/2009 | Campling |
| 7,659,464 | B1 | 2/2010 | Kokodis |
| 7,687,698 | B2 | 3/2010 | Kim |
| 7,705,224 | B1 | 4/2010 | Ward |
| 7,816,592 | B2 | 10/2010 | Babicz |
| 7,838,750 | B2 | 11/2010 | Steinberger |
| 7,893,328 | B1 | 2/2011 | Rigaud et al. |
| 7,932,448 | B1 | 4/2011 | Bochar, Jr. |
| 8,835,730 | B2 | 9/2014 | Bagale |
| 9,368,092 | B2 | 6/2016 | Hooker |
| 9,454,947 | B1 | 9/2016 | Hart et al. |
| 2003/0145712 | A1* | 8/2003 | Steinberger ..... G10D 3/06 84/293 |
| 2008/0092716 | A1 | 4/2008 | Breedlove et al. |
| 2012/0312142 | A1 | 12/2012 | Serrangeli |
| 2018/0197511 | A1 | 7/2018 | Grifols |

FOREIGN PATENT DOCUMENTS

| | | |
|---|---|---|
| CN | 105225656 | 11/2018 |
| EP | 0978820 | 2/2000 |
| EP | 2323127 | 5/2011 |
| ES | 2675826 | 12/2018 |
| GB | 2460245 | 7/2010 |
| IT | 1398037 | 2/2013 |
| JP | 2000066661 | 3/2000 |
| JP | 2006047713 | 2/2006 |
| JP | 2011095747 | 5/2011 |
| JP | 5879135 | 3/2016 |
| JP | 2018124421 | 8/2018 |
| WO | 200070599 | 11/2000 |
| WO | 2000074032 | 12/2000 |
| WO | 2004097790 | 11/2004 |
| WO | 2008051435 | 5/2008 |
| WO | 2017154662 | 9/2017 |

OTHER PUBLICATIONS

Larkin, "Making Acoustic Guitar Necks and Bolting Them to Bodies", Chris Larkin Guitars, https://www.chrislarkinguitars.com/shop/talks.html, 2017, pp. 1-61.

Taylor Guitars, https://www.taylorguitars.com/guitars/electric/solidbody/neck, 2014, pp. 1-2.

Wildwood, "1960s HOPF Classical Guitar", Jake Wild Wood Country Guitar Doctor, https://jakewildwood.blogspot.com/2015/05/1960s-hopf-classical-guitar.html, 2015, pp. 1-13.

* cited by examiner

LINEAR DOVETAIL NECK JOINT FOR MUSICAL INSTRUMENT

RELATED APPLICATION

This application claims the benefit of priority to U.S. Provisional Patent Application Ser. No. 62/864,770, filed on Jun. 21, 2019, the contents of which are incorporated in this application by reference.

TECHNICAL FIELD

The present invention relates generally to the neck joint in a stringed musical instrument such as a guitar and, more specifically, to a neck joint that facilitates linear and angular adjustments between the neck and body of the instrument which are connected by the neck joint.

BACKGROUND OF THE DISCLOSURE

Music plays an important role in our daily lives and is woven into the fabric of society. Many people perform music as a pastime, a hobby, or an occupation. One of the main divisions of instruments, chordophone instruments are musical instrument that make sound by way of a vibrating string or strings stretched between two points. Chordophone instruments, and in particular string instruments, are very popular worldwide because they are versatile and suited to different genres of music. The most popular of the string instruments is probably the modern guitar, including both acoustic guitars which project sound acoustically and electric guitars which project sound through electrical amplification. Conventional acoustic and electric guitars include a body and a neck that is attached to the body via a joint, with one or more elongate, flexible strings extending between the body and a distal end of the neck along a fretboard. (The terms "distal" or "distal end" are used to define the part or surface of an element which is positioned furthest from the user.)

There are three general kinds of neck joints which have been used in stringed musical instruments. "Neck-through" instruments have a neck that extends completely through the instrument, and is almost always permanently glued in place. "Set-neck" instruments have a neck which is also permanently glued in place, with a tenon or dovetail joint where the body meets the neck. These instruments usually have a neck heel just forward of the body which extends down to the back of the body to provide support. Finally, there are "bolt-on" instruments (screwed-on would actually be more accurate) which have an opening in the body where the neck overlaps the body, and where bolts (or screws) are located which join the neck to the body. Generally, in this type of instrument, the neck joint is made solid so that no movement between the neck and body is possible during use of the instrument. The bolts can be loosened, however, so that the neck can be removed from or repositioned in the body.

Acoustic guitars are traditionally set-neck instruments, with a neck heel just forward of the body and extending down to the back of the body. This forward protrusion beneath the neck adjacent the body restricts access to the highest region of the fretboard during play. Electric guitars are commonly either set-neck instruments or bolt-on instruments. Common bolt-on instruments are economical to construct and repair. The drawbacks of the existing bolt-on designs are that the joint has less side-to-side rigidity than glued necks, and access to the highest region of the front of the fretboard, near the body, is restricted by the body portion extending under the overlap of the neck. Given the drawbacks of bolt-on designs, most conventional acoustic and electric guitars permanently affix the neck to the body of the guitar during manufacture and assembly of the guitar. A common disadvantage of such permanent fixation mechanisms is that the neck cannot be readily displaced from the body for convenient adjustment of the characteristics of the guitar.

As is well known in the art, the primary quality characteristics of guitars are tone (i.e., the audible nature of the instrument including volume, brightness, evenness, note separation, etc.), playability (i.e., the responsiveness of the instrument to the player's technique), and durability or sustain (i.e., the ability of the instrument to deliver tone and playability over years and decades). The neck joint is important to each of these three guitar characteristics. A brief discussion follows of how the neck joint affects the tone, sustain, and playability characteristics of a guitar.

With respect to tone, the transfer of vibrations is critical to the tone or sound of a guitar. The intersection where the neck and body meet (i.e., the neck joint) forms a sort of "sonic crossroads." Thus, the neck joint is a vital part of the sound traffic pattern within a guitar where treble, bass, midrange, fundamentals, and all forms of harmonics decide to pass or take the off-ramp. Depending on the type of neck joint, the result of this physics-driven filtering system defines to a large extent the tone of the guitar.

The term "sustain" is intended to mean a measure of musical sound over time. More particularly, sustain refers to the period of time that the sound of the guitar continues until it becomes inaudible. The sustain of a guitar is diminished by the conventional mechanisms used to attach guitar necks and bodies. In general, the more rigid the mechanical connection between the neck and the body of a guitar, the longer the sustain of the guitar. In addition, a rigid mechanical connection between the neck and the body of the guitar typically improves the quality and consistency of the tone of the musical sound produced by the guitar. It is desirable, therefore, to provide a substantially rigid mechanical connection between the neck and the body of a guitar. Such desirability also explains why the majority of guitars made today continue to be constructed with a neck that is tightly fitted and glued into the body of the guitar (i.e., set-neck guitars).

Finally, consider playability. Important to the playability of a stringed instrument is the distance that the string lies above the neck. The height of the string relative to the neck and the fretboard is commonly referred to as the "action" of a string. Typically, the desired action on a guitar is subject to each user's personal preference. Certain musicians prefer to have a smaller distance between the fretboard and the strings or "low" action while others require a high action. If the action is too high, playing is difficult, unpleasant, and, in extreme cases, can cause repetitive stress injury. If the action is too low, the strings will "buzz" on the frets or may actually rest on the frets, making the instrument generally unplayable. In general, minute differences in the height that the string is above the neck can make a major difference in the performance of amateur and professional musicians alike. The acceptable range for action is quite small—perhaps 2.5 mm (0.1 of an inch) or so.

In view of this small range, guitars must be built very precisely with respect to their neck joint and must maintain that critical geometry throughout time under the stress up to 180 pounds of string tension. On a traditional guitar, the action of the instrument is usually set at the factory and changes to the action must be made by an experienced technician. Furthermore, the traditional guitar normally has a very limited range of movement and significant changes to the action of the instrument may only be able to be accomplished by modifying the structure of the body or neck of the instrument. These types of modifications can be quite costly and can have a serious effect on the long-term performance of the guitar. Consequently, it is desired to have a musical instrument that allows the user to quickly and efficiently adjust the action on the instrument.

Several known string instruments change the action of the instrument by adjusting the angle of inclination at which the neck extends from the guitar body. These instruments rely on the principle that when the angle between the neck and the body is increased the action is lowered and when the angle is decreased the action is raised. The action can be raised or lowered by adjusting the angle between the neck and the body of the guitar. Changing the angle of the neck relative to the body also affects, however, the intonation, tonal properties, and scale lengths of the guitar strings. The disadvantage to these designs is that the user cannot adjust the action of the neck without altering the intonation and sound of the guitar.

For instance, U.S. Pat. No. 6,051,766 discloses a guitar in which the neck angle is changed relative to the guitar body by placing shims of varying widths into the guitar cavity where the neck is secured to the guitar body. Another adjustable neck is disclosed in U.S. Pat. No. 6,265,648 which provides for a neck secured to the guitar body via a spring-loaded clamping device that creates a pivot point allowing for movement of the neck at an angle relative to the body. Neither of these devices permit the user to adjust the linear direction of the neck without also changing the angle of the neck relative to the body. Further, the '766 patent requires the user to disassemble the neck from the guitar body in order to adjust the action of the guitar strings. Still further, the '648 patent relies on the biasing force of a spring to hold the neck in place. This spring force is likely to degrade over time rendering the neck unstable. The force provided by the spring also creates an upward force on the neck-body joint which can lead to damage of various components of the guitar. Consequently, it is desired to have a neck which can also be easily adjusted in a linear direction without affecting the angle that the neck extends from the body.

A rigid guitar structure generally tends to be excessively heavy and may compromise tone. A lighter guitar structure tends to sound better with the risk that the neck may eventually pull up over time, altering the action of the strings to the point where the neck must eventually be reset, typically entailing a costly repair of many hundreds of dollars. Accordingly, the tone, the playability, and the durability or sustain of a guitar are fundamentally in conflict with one another and trade-offs are often required in design. Some luthiers view balance of the three characteristics as preferable.

Even after a luthier completes manufacture of the guitar, the user may want to change the characteristics of the guitar. Musicians often desire to use a guitar having different characteristics for a variety of reasons. The ease and comfort of play, as well as the tone or sound produced by a guitar, are highly dependent on characteristics of the neck joint. Currently, the only practical way to change the characteristics of a guitar is to use another guitar having a different configuration (including type of neck joint). In addition to cost, using multiple guitars having different configurations exacerbates storage and transport concerns.

Guitars are made mostly of wood, and wood tends to move over time both under string tension and in response to day-to-day humidity changes. A guitar with comfortably low action in Houston, Tex., for example, might shrink enough if flown to Minneapolis, Minn. during the winter to be generally unplayable. The luthier must anticipate that the guitar may spend some time in low humidity so the stringed instrument must have sufficiently high action to remain playable under all foreseeable circumstances. Unfortunately, the action generally will be sub-optimized when the humidity is higher.

As a result, guitars normally tend to have an action that is higher than desirable to allow for the possibility that the stringed instrument will eventually experience a low-humidity environment. As string tension gradually deforms the wood structures over time, the action is likely to increase and progressively get worse. Modification of the action of the stringed instrument, whether by the musician, owner, technician, or repair person, is typically hampered because many guitars have fixed necks which limit the range of any relatively easy adjustment of the string action.

One approach of attempting to modify the action of a guitar, with a fixed neck, is to unstring the guitar and then remove and shave the saddle. Because the height of the saddle is typically small, the saddle must be significantly shaved in order to have any real effect on the string action. In addition, an adjustment in saddle height may only temporarily solve the problem. Moreover, a short saddle tends to reduce the leverage that the strings have to vibrate the top surface of the guitar body so both the tone and the volume of the guitar are generally compromised to some extent.

More often, the musician, owner, technician, or repair person will attempt to adjust a truss rod. A truss rod generally consists of a threaded rod, with nuts located on either end, which extends parallel to another rod or bar. By rotating the threaded rod in one direction or the other, the truss rod eventually begins to bend thereby causing the neck and associated fret board to also correspondingly bend. It is to be appreciated that using the truss rod to compensate for more than minute amounts of relief is generally a bad option because such adjustment frequently results in a broken truss rod and this typically leads to the guitar eventually being discarded by the owner.

Some luthiers have incorporated various mechanisms to adjust the geometry of the neck joint. More than a century ago, they tried adjustable neck joints. A number of luthiers today use neck joints that can be adjusted in one manner or another. Given their drawbacks, however, only a small fraction of all guitars have such neck adjustment systems.

The most common approach is to enable the headstock end of the neck to "tilt" slightly in relation to the body, e.g., pivoting where the neck heel contacts the body. The pivoting is controlled by a screw extending through the neck heel into the body well below the pivot point. Rotation of the screw in a first direction pushes the heel farther from the body and effectively pushes the headstock back, reducing the distance from the strings to the fretboard and lowering the string action. U.S. Pat. No. 7,157,634 discloses an example of this approach. Because the pivot point is well below the plane of the strings, such tilting also increases the distance between the nut and the saddle. Considerable force must be applied by the adjustment mechanism, because the strings are already under approximately 180 pounds of tension, so prudence may require the guitar to be unstrung before an adjustment is attempted. In any event, any stretching or relaxing of the strings will change the pitch of the strings, thereby requiring the player to retune the guitar following adjustment. It is to be appreciated that a significant adjustment may change the distance between the nut and the saddle enough that the new effective scale length no longer matches the layout of the frets and the instrument may sound out of tune. In order to make the most effective use of such a principle, the adjustable range must be set by the manufacturer in the middle of its potential travel to allow adjustments in both directions.

Another approach is to raise and lower the entire neck with respect to the guitar body using, for instance, a sliding mortise and tenon joint. Such a system is described in U.S. Pat. No. 7,557,281, although other "elevator" systems are available and known in the art. Elevator systems typically also stretch or relax the strings, for a given change in action, but typically less than a tilt system discussed above. Even if the direction of travel is very close to being precisely perpendicular to the string plane, however, some stretching or relaxing of the strings will typically occur as a matter of geometry, which changes the pitch of the strings.

Although neck and body portions have been formed as a single integral unit, a variety of guitars have been made in which the neck and body portions are formed from separate portions that are attached together to form the instrument. A number of neck and body attachments are known in the art. Each of the existing attachments has a variety of problems. Among other things, existing attachments can be difficult to assemble, costly to assemble, structurally unsound, and aesthetically undesirable. Thus, there exists a continued need in the art for improved neck and body attachment methods and devices. There specifically exists a need for a highly practical and mass-producible neck-mounting or joint mechanism that permits simple adjustment of neck position in the plane of the face of the body.

BRIEF SUMMARY OF THE DISCLOSURE

To meet these and other needs and to overcome the shortcomings of existing neck joints, a linear dovetail neck joint for musical instruments is provided. An object of the present disclosure is to facilitate quick and easy adjustment of the relative height and angle of the neck, with respect to the body of the stringed instrument, so that the action and intonation of the strings can be readily modified by the user or musician. A related object is to have a neck which can be easily adjusted in a linear direction without affecting the angle at which the neck extends from the body. It is still another object of the present disclosure to provide a neck joint that secures the neck onto the body with a rigid mechanical connection. Yet another object is to provide a neck joint that does not adversely affect the musical tone or sound, the playability, or the sustain of the instrument.

To achieve these and other objects, and in view of its purposes, the present disclosure provides a linear dovetail neck joint for a musical instrument having a neck, a body, and a fretboard. The linear dovetail neck joint relies on an internal dovetail with screw-adjustable tension while avoiding screws that go directly into the neck. The linear dovetail neck joint allows for extreme fret accessibility in the upper register of the fretboard (due to lack of heel on the neck), easier neck height adjustments, intonation correction, and unique front block configurations with hand relief—all without the need for adhesives. The linear dovetail neck joint permits a practical and aesthetically pleasing neck-to-body joint without the need for a heel on the neck. The result is a neck-to-body joint that is easily adjustable and serviceable.

More specifically, the linear dovetail neck joint for a musical instrument includes a neck having a bottom surface with a mortise. A block has a contoured surface that forms part of the body of the musical instrument when the block is fastened to the body, a top platform with a hole that is accessible from outside the musical instrument and is configured to receive a fastener, and a rear surface with a window. A shim sleeve is configured to be inserted into the window in the rear surface of the block. At least one substantially flat shim is configured to be inserted into the shim sleeve, the shim having a top portion with a height that defines the distance by which the linear dovetail neck joint separates the neck from the block as the bottom surface of the neck rests on the top portion of the shim when the linear dovetail neck joint is fully assembled. A dovetail key engages at least indirectly the mortise of the neck and has a top, a bottom, and an opening extending through the dovetail key from the top to the bottom. The opening is aligned with the hole of the block and is configured to receive the fastener. Rotation of the fastener in the opening causes the fastener to pull the dovetail key downward along with the neck toward the top platform of the block and attaches the dovetail key and the neck to the block.

Even more specifically, the linear dovetail neck joint has two, main components: a modified neck and a block with a contoured surface that forms part of the body when the block is fastened to the body. An intonation set screw moves the neck relative to the body and adjusts the intonation of the musical instrument. The neck has a top surface with a passage configured to receive a truss rod and a bottom surface with a mortise and at least two slots. In addition to (i) the contoured surface that forms part of the body when the block is fastened to the body, the block has (ii) an underside, (iii) a top platform with a recess, a first hole that extends from the top platform through the underside and aligns with a third hole in a rear plate of the body and is accessible from outside the musical instrument and is configured to receive a first fastener, a second hole that extends from the top platform through the contoured surface and is accessible outside the musical instrument and is configured to receive a second fastener, and at least two alignment orifices with one alignment orifice aligned with and corresponding to each one of the at least two slots in the bottom surface of the neck when the linear dovetail neck joint is fully assembled, and (iv) a rear surface with a window, an aperture configured to receive the intonation set screw, and an access aligned with the passage in the top surface of the neck and configured to receive the truss rod.

At least two alignment pins are provided. One alignment pin is inserted partially into each one of the at least two alignment orifices in the top platform of the block and into the aligned and corresponding one of the at least two slots in the bottom surface of the neck when the linear dovetail neck joint is fully assembled. The alignment pins align the neck with the block and prevent side-to-side movement of the neck.

The linear dovetail neck joint further includes a number of separable components in addition to the main components of the neck and the block. Among those separable components are a shim sleeve, one or more shims, a dovetail key, a spring cage, and a dovetail slide. Each of those components are summarized with reference to how they interact with the neck, the block, and the other separable components.

The shim sleeve is configured to be inserted into the window formed in the rear surface of the block. The shim sleeve has a front face, a bottom with an upstanding rib to ensure correct orientation, and side walls each with a respective slot.

At least one substantially flat shim is configured to be inserted into the shim sleeve and to engage the shim sleeve in a snug friction-fit manner. The shim has a top portion with a height that defines the distance by which the linear dovetail neck joint separates the neck from the body as the bottom surface of the neck rests on the top portion of the shim when the linear dovetail neck joint is fully assembled, a bottom with a track configured to receive the rib of the shim sleeve, and side walls each with a respective flexible and spring-like latch. Each latch includes a first projection configured to snap into engagement in the respective slots of the side walls of the shim sleeve when the shim is fully seated in the shim sleeve. A second projection extends a short distance beyond the front face of the shim sleeve and protrudes into the neck pocket when the shim is fully seated in the shim sleeve.

The dovetail key has a top, a bottom, and a central longitudinal axis with a first opening and a second opening each aligned along the axis and extending through the dovetail key from the top to the bottom. The first opening is aligned with the first hole of the block and is configured to receive the first fastener and the second opening is aligned with the second hole of the block and is configured to receive the second fastener. Rotation of the first and second fasteners in the corresponding first and second openings causes the fasteners to pull the dovetail key downward toward the top platform of the block and attaches the dovetail key to the block.

The spring cage has a base with a top planar surface. The base is configured to fit snugly in the recess of the top platform of the block. The spring cage further has a plurality of springs extending upward above the planar surface of the base and applying an upward force against the bottom of the dovetail key to fix the dovetail key in position against the downward pull of the fasteners. This upward force also facilitates release of the neck joint when desired.

Finally, the dovetail slide is configured to fit snugly within and reinforce the mortise in the neck. The dovetail slide engages the dovetail key when the neck is affixed to the block and facilitates movement between the neck and the block. It also prevents deformation of either surface through appropriate hardness or tempering of materials.

It is to be understood that both the foregoing general description and the following detailed description are exemplary, but are not restrictive, of the invention.

BRIEF DESCRIPTION OF THE DRAWING

The disclosure is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE DISCLOSURE

An improved system is provided for mounting the neck of an instrument to the instrument body in a manner so that the position of the neck relative to the body can be easily, quickly, accurately, and repeatedly adjusted in both linear and angular directions. The system also allows the user to quickly adjust the linear distance between the nut and saddle without any change in the angle of the neck relative to the body. Consequently, the user can quickly and efficiently change the action of the guitar and adjust the intonation or scale length of the guitar.

The stringed musical instruments in accordance with the present invention may include guitars, such as acoustic guitars, solid body electric guitars, and acoustic electric guitars, but may also include other stringed musical instruments such as, for example, banjos, mandolins, violins, lutes, and/or other similar instruments. Although the principles of the present disclosure are described in connection with guitars, it should be understood that the principles disclosed are also applicable to other stringed instruments which have an instrument body and an elongated neck along which the strings are stretched.

Figure 1:
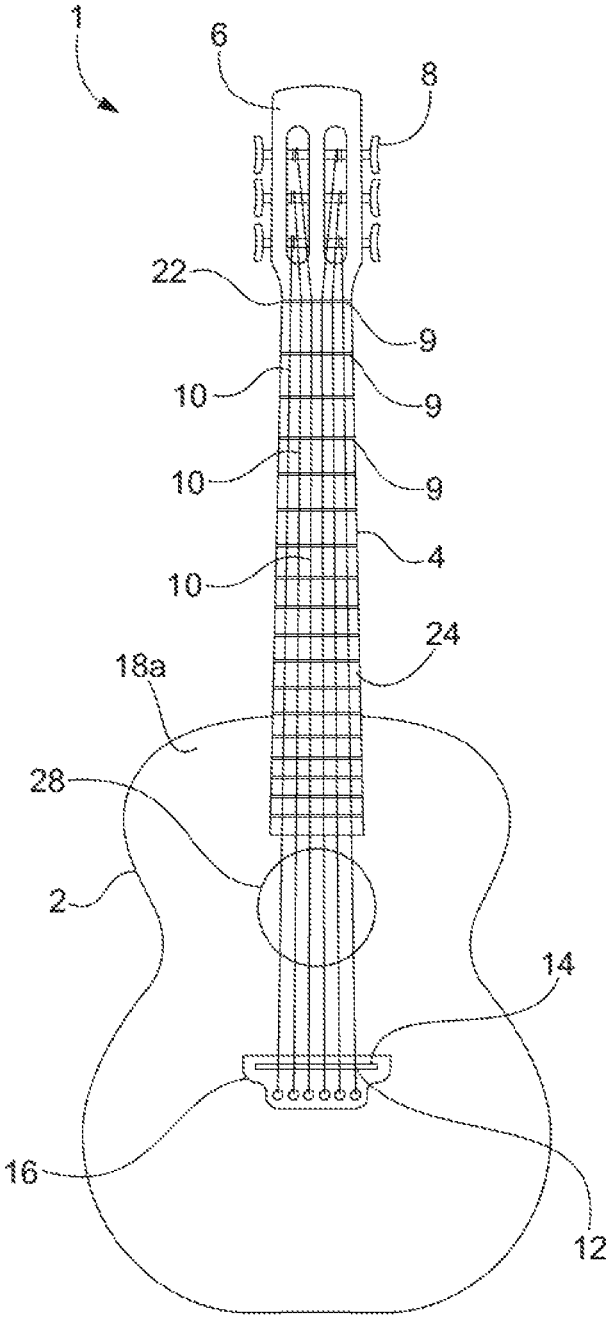
FIG. 1 is a diagrammatic perspective view of a conventional guitar.
Figure 2:
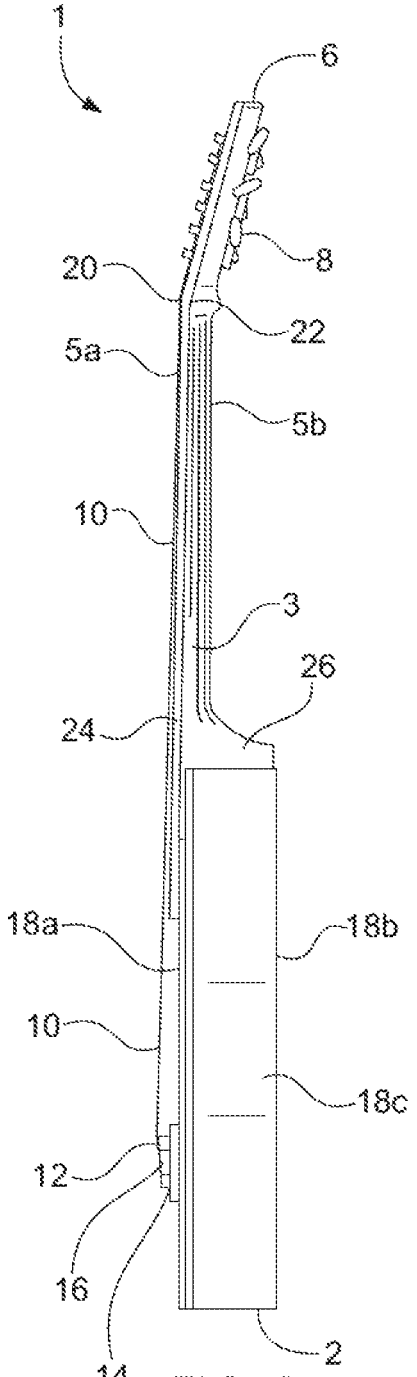
FIG. 2 is a diagrammatic side view of the guitar illustrated in FIG. 1.

Refer now to the drawing, in which like reference numbers designate like elements throughout the various figures that comprise the drawing. Turning first to FIGS. 1 and 2, a brief description concerning the various components of the stringed instrument, according to both the prior art and the present invention, will now be briefly discussed. As shown in these figures, the guitar 1 has a guitar body 2 connected to a neck 4 in a conventional manner. The body 2 is comprised of a front plate 18*a* having a circular sound hole 28, a rear plate 18*b* facing the front plate 18*a*, and a lateral plate 18*c* combined with edges of the front plate 18*a* and the rear plate 18*b* in a way to be spaced apart from each other. Sound resonance is generated in the internal space formed by the front plate 18*a*, the rear plate 18*b*, and the lateral plate 18*c*. Further, formed in one side of the body 2 is an aperture into which the neck 4 is inserted.

The neck 4 takes the form of a beam 3 having a considerable thickness with a top surface 5*a* and a bottom surface 5*b*. The neck 4 typically comprises a wood or some other similar or conventional material, which is suitable to withstand continual string pull without warping or twisting. The neck 4 has an integral headstock 6 which holds a number of separate tuning pegs 8 (typically six or possibly twelve tuning pegs) which each, in turn, respectively retain a free end of a desired string 10 in a conventional manner. The strings 10 are strung at substantial tension (e.g., about 30 pounds of tension per string) and extend from a first fixed point or axis 12, formed by a saddle 14 supported by a bridge 16 which is permanently affixed to the front plate 18*a* of the guitar body 2, to a second fixed axis 20, formed by a nut 22 which is permanently affixed to the top surface 5*a* of the neck 4, located adjacent the headstock 6. Further, installed inside the beam 3 of the neck 4 is an adjustment rod (not shown) for preventing the neck 4 from bending or being distorted by the tension force of the guitar strings 10.

A fingerboard (also known as a fretboard 24 on fretted instruments) is an important component of most stringed instruments. The fretboard 24 is a thin, long strip of hard material, usually a re-enforced polymer or wood such as rosewood or ebony, that mates with and is formed on the top surface 5*a* of the neck 4 so as to be located between and space a remainder of the neck 4 from the strings 10. The material from which the fretboard 24 is manufactured should be strong, durable, and stable enough to support and retain the metal frets 9, which are installed on top of the fretboard 24 at regular intervals, and withstand playing wear for years of use. The strings 10 run over the fretboard 24 between the nut 22 and the bridge 16. For conventional guitars 1, a heel 26 is formed integrally with a remainder of the neck 2 and extends from the bottom surface 5*b* of the neck 4.

When using the guitar 1, the musician moves his or her fingers up and down the neck 4, pressing the strings 10 so as to shorten them and create various pitches as the strings 10 are strummed, plucked, or otherwise excited. Typically, the frets 9 on the fretboard 24 extend across the width of the neck 4 so as to provide a place to anchor the ends of the shortened strings 10 at definite or desired locations.

In the case of an acoustic instrument, such as an acoustic guitar 1, the body 2 encloses a resonant sound chamber. Strumming, plucking, or otherwise exciting the strings 10 causes the strings 10 to vibrate. This vibration in turn causes the bridge 16 over which the strings 10 extend to vibrate as well. In fact, the bridge 16 forms the vibrating end point of the strings 10 for every note that is played. Vibration of the bridge 16 in turn causes the front plate 18*a* of the acoustic instrument, known as the soundboard, to vibrate as well, which in turn causes air entrapped in the sound chamber to move to generate the sound heard through the sound hole 28 upon play of the instrument.

Normally, the strings 10 are tuned to pitch at the top of the neck 4 or headstock 6 where the tuning pegs 8 increase or decrease the tension on each string 10. The user then renders the desired notes by strumming the strings 10 near the middle of the guitar body 2 while pressing the strings 10 which extend over the neck 4 onto the fretboard 24 attached to the top surface 5*a* of the neck 4. The tone of the note produced depends on the tension of the string 10 and the distance between the fret 9 at which the string 10 is depressed onto the neck 4 and the lower anchor point. The smaller the distance between the depressed string 10 and the bridge 16, the higher pitch the resulting tone will be. Increasing the tension of the strings 10 will also produce a note with a higher pitch.

Figure 3:
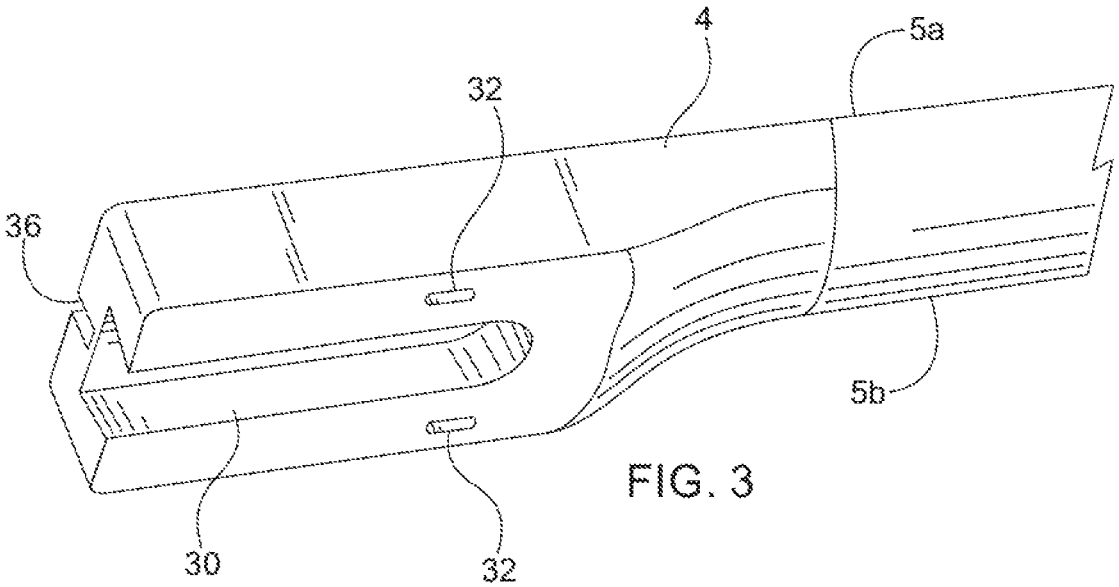
FIG. 3 is a bottom perspective view of the guitar neck highlighting the components of the neck that form part of the linear dovetail neck joint.

FIG. 3 is a bottom perspective view of the neck 4 highlighting the components of the neck 4 that form part of the linear dovetail neck joint. The bottom surface 5*b* of the neck 4 has a mortise 30, preferably although not necessarily trapezoidal in cross section and rectangular in shape, cut into the bottom surface 5*b*. The sides of the trapezoidal cross section of the mortise 30 may be cut at an angle of about 28 degrees from vertical. The width, length, and height of the mortise 30 may be about 1 inch (2.5 cm), 3.35 inches (8.5 cm), and 0.55 inches (1.4 cm). These dimensions are, of course, only examples. Located on either side of the mortise 30 are one of a pair of slots 32 sized and shaped to receive alignment pins 34 (see FIG. 14). On the top surface 5*a* of the neck 4, a passage 36 is provided (typically cut into the top surface 5*a*).

Figure 4A:
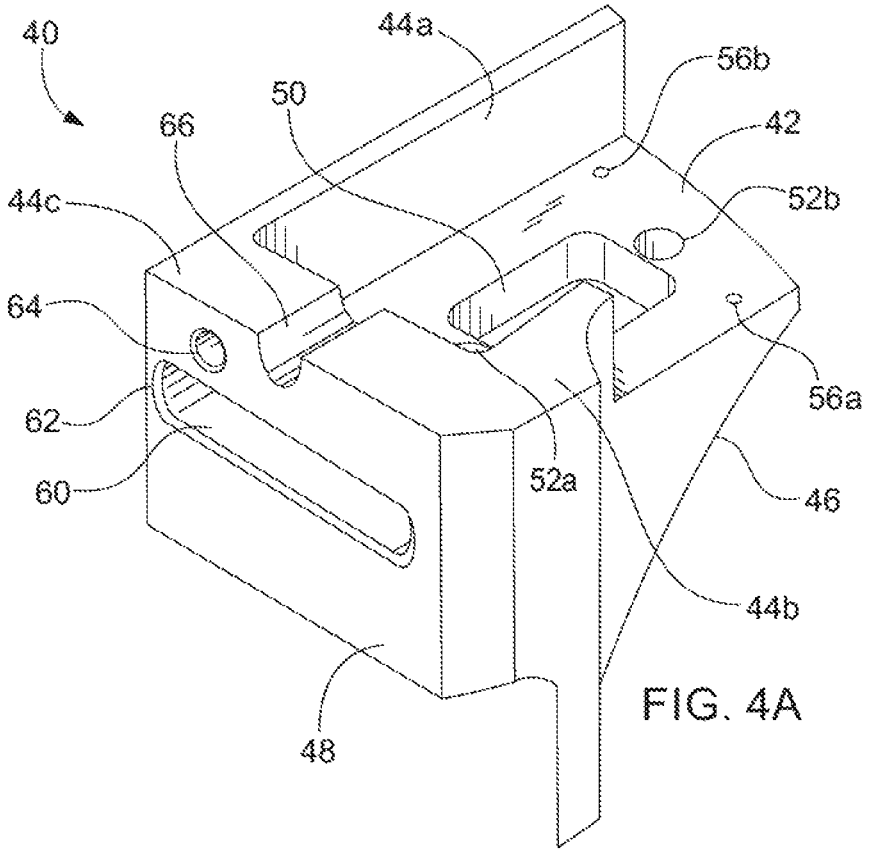
FIG. 4*a* is a rear perspective view of the guitar block highlighting the components of the block that form part of the linear dovetail neck joint.
Figure 4B:
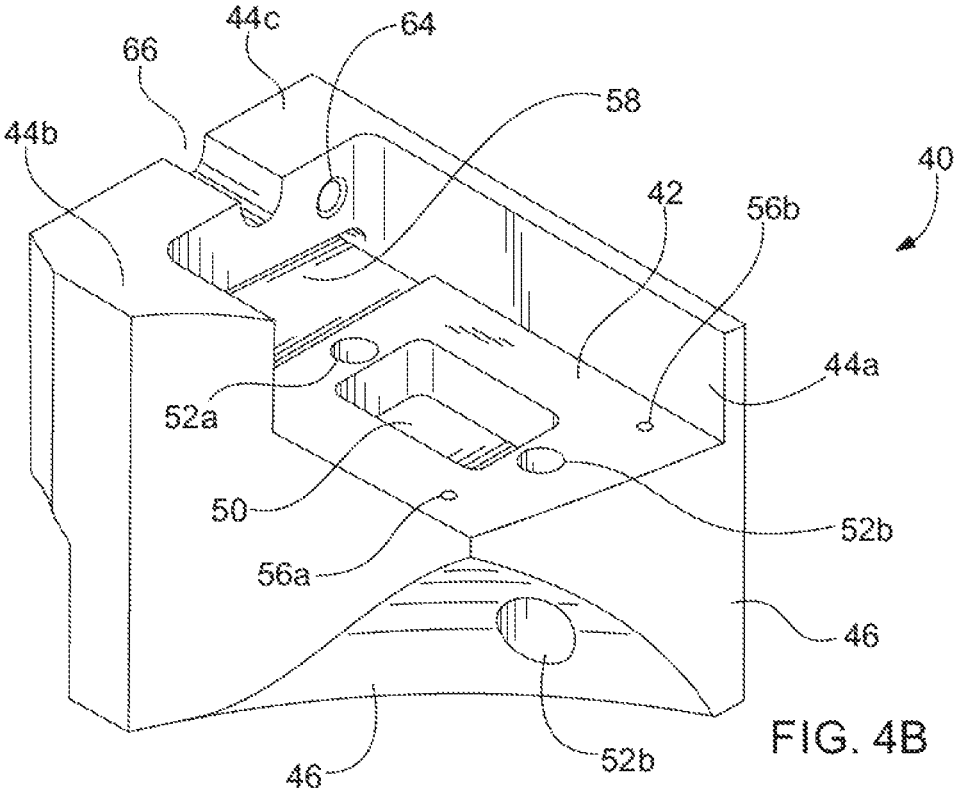
FIG. 4*b* is a front perspective view of the block shown in FIG. 4*a;*

FIGS. 4*a* and 4*b* illustrate the block 40 highlighting the components of the block 40 that form part of the linear dovetail neck joint. FIG. 4*a* is a rear perspective view, and FIG. 4*b* is a front perspective view, of the block 40. The block 40 has a top platform 42 defined by a full side wall 44*a*, a rear wall 44*c*, and a partial side wall 44*b*. The full side wall 44*a* extends along the entire length of the top platform 42; the partial side wall 44*b* extends along only about one-third of the length of the top platform 42. The rear wall 44*c* connects the full side wall 44*a* and the partial side wall 44*b*. The front of the block 40 is defined by a contoured surface 46 that forms part of the guitar body 2 when the block 40 is fastened (typically glued) to the guitar body 2. The rear of the block 40 is defined by a flat surface 48 that resides inside the guitar body 2 when the block 40 is fastened to the guitar body 2. The block 40 may be formed as one, integral piece. By "integral" is meant a single piece or a single unitary part that is complete by itself without additional pieces, i.e., the part is of one monolithic piece formed as a unit. Alternatively, the block 40 may be formed by fastening (typically using glue) sections together.

Although the block 40 could be made of plastic, the block 40 is preferably made of wood. Tests were conducted comparing the performance of a guitar 1 having a wooden block 40 versus a plastic block 40. The results of those tests were that the guitar 1 with the wooden block 40 had slightly higher amplitude in the fundamentals, slightly higher in the mid-range, slightly less in the high mid-range, and more again in the high frequency range. All results were on the order of 6 dB or less. Balance, clarity, and harmonic content excelled with the wooden block 40 versus the plastic block 40. The guitar 1 having the plastic block 40 yielded a flatter, dimensionless tonal quality with less production of harmonics, depth of sound, and overtones. The guitar 1 having the plastic block 40 suffered from harsh treble tones. The sustain was slightly longer with the plastic block 40, but this might be attributed to natural variation in build and setup.

The top platform 42 of the block 40 has a recess 50 (typically cut) in it. The recess 50 is preferably, although not necessarily, rectangular in shape with dimensions of about 1.44 inches (3.65 cm) by 0.875 inches (2.22 cm) and a depth of about 0.930 inches (2.36 cm). A pair of holes, namely a first hole 52*a* and a second hole 52*b*, are located adjacent the short sides of the recess 50 in the top platform 42. Each of the first hole 52*a* and the second hole 52*b* is preferably, although not necessarily, round and has a diameter of about 0.32 inches (0.80 cm). The first hole 52*a* extends from the top platform 42 to and through the underside of the block 40 and is accessible from outside the guitar 1 through a corresponding third hole 52*c* in the rear plate 18*b* of the body 2 of the guitar 1; the second hole 52*b* extends from the top platform 42 to and through the contoured surface 46 of the block 4 and is directly accessible outside the guitar 1.

Figure 5:
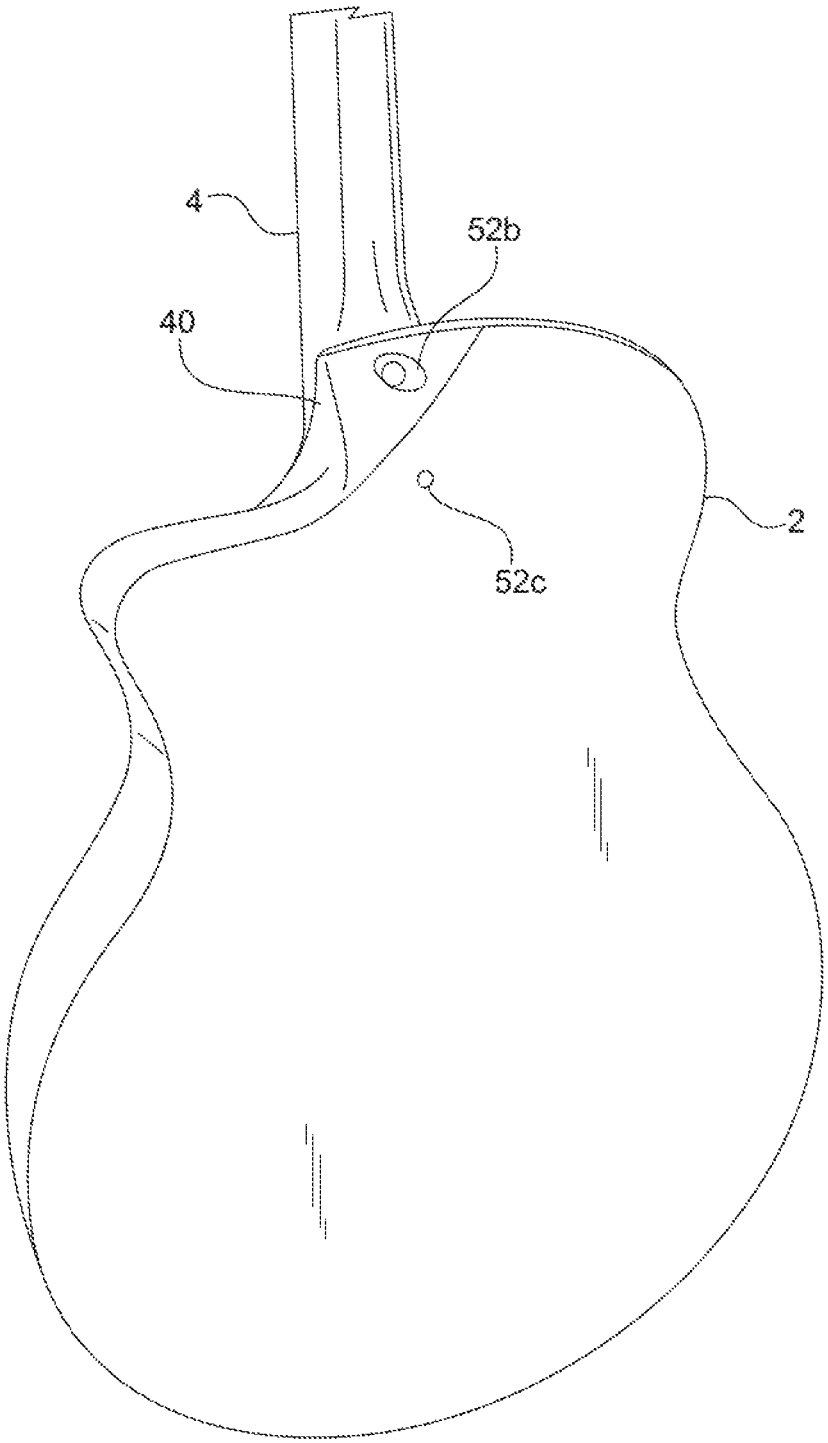
FIG. 5 depicts the guitar with the neck and the body connected via the linear dovetail neck joint, highlighting the locations of a first hole and a second hole.

FIG. 5 depicts the guitar 1 with the neck 4 and the body 2 connected via the linear dovetail neck joint, highlighting the locations of the first hole 52*a* and the second hole 52*b* in the block 40. Located closer to the neck-to-body joint than the first hole 52*a*, the second hole 52*b* is recessed into the exposed portion (specifically, into the contoured surface 46) of the block 40 and is both externally visible and accessible. In contrast, the first hole 52*a* is hidden from view when the stringed instrument is fully assembled. The first hole 52*a* is accessible through an accurately aligned, corresponding, third hole 52*c* in the rear plate 18*b* of the body 2 of the guitar 1, which allows the user to access the first hole 52*a* (through the third hole 52*c*) without having to reach into the sound hole 28 of the guitar 1. The third hole 52*c* may be reinforced with a protective or decorative grommet (not shown) as would be known by an artisan. The first hole 52*a* and the second hole 52*b* are configured to receive fasteners such as threaded bolts 54*a* and 54*b*, which each have a head with a slot. A conventional tool (such as an Allen wrench) may be used to engage the slot and rotate the fasteners. FIG. 5 shows that the block 40 is affixed to the body 2 of the guitar 1 at approximately the center of the body 2.

Returning to FIGS. 4*a* and 4*b*, the top platform 42 of the block 40 also has a first alignment orifice 56*a* and a second alignment orifice 56*b* (typically cut) in it. Each of the first alignment orifice 56*a* and the second alignment orifice 56*b* is preferably, although not necessarily, round and has a diameter of about 0.12 inches (0.30 cm). The first alignment orifice 56*a* and the second alignment orifice 56*b* form blind holes in the body of the block 40 into which alignment pins 34 can be inserted partially. A portion of each alignment pin 34 protrudes outward from the alignment orifices 56*a* and 56*b* (and above the top platform 42) when the alignment pins 34 are fully inserted into the alignment orifices 56*a* and 56*b*.

When inserted into the first alignment orifice 56*a* and the second alignment orifice 56*b* of the block 40, the alignment pins 34 help the user to align the neck 4 with the block 40 upon engagement of the neck 4 with the block 40. Specifically, the user aligns the pair of slots 32 in the neck 4 with the portions of the alignment pins 34 that extend outside the alignment orifices 56*a* and 56*b* and inserts those portions into the slots 32 by pushing the neck 4 toward the block 40. The alignment pins 34 prevent unwanted lateral movement between the neck 4 and the block 40 when the linear dovetail neck joint is completely assembled.

A shelf 58 is formed in the block 40 and extends from the top platform 42 to the flat surface 48, under the rear wall 44*c* and partially into each of the full side wall 44*a* and the partial side wall 44*b*. The shelf 58 ends at the flat surface 48 at a window 60 formed in the flat surface 48. The window 60 is surrounded by a notch 62. The window 60 has, for example, a substantially rectangular or oval shape defining a width of about 2.33 inches (5.92 cm) and a height of about 0.375 inches (0.95 cm).

Figure 14:
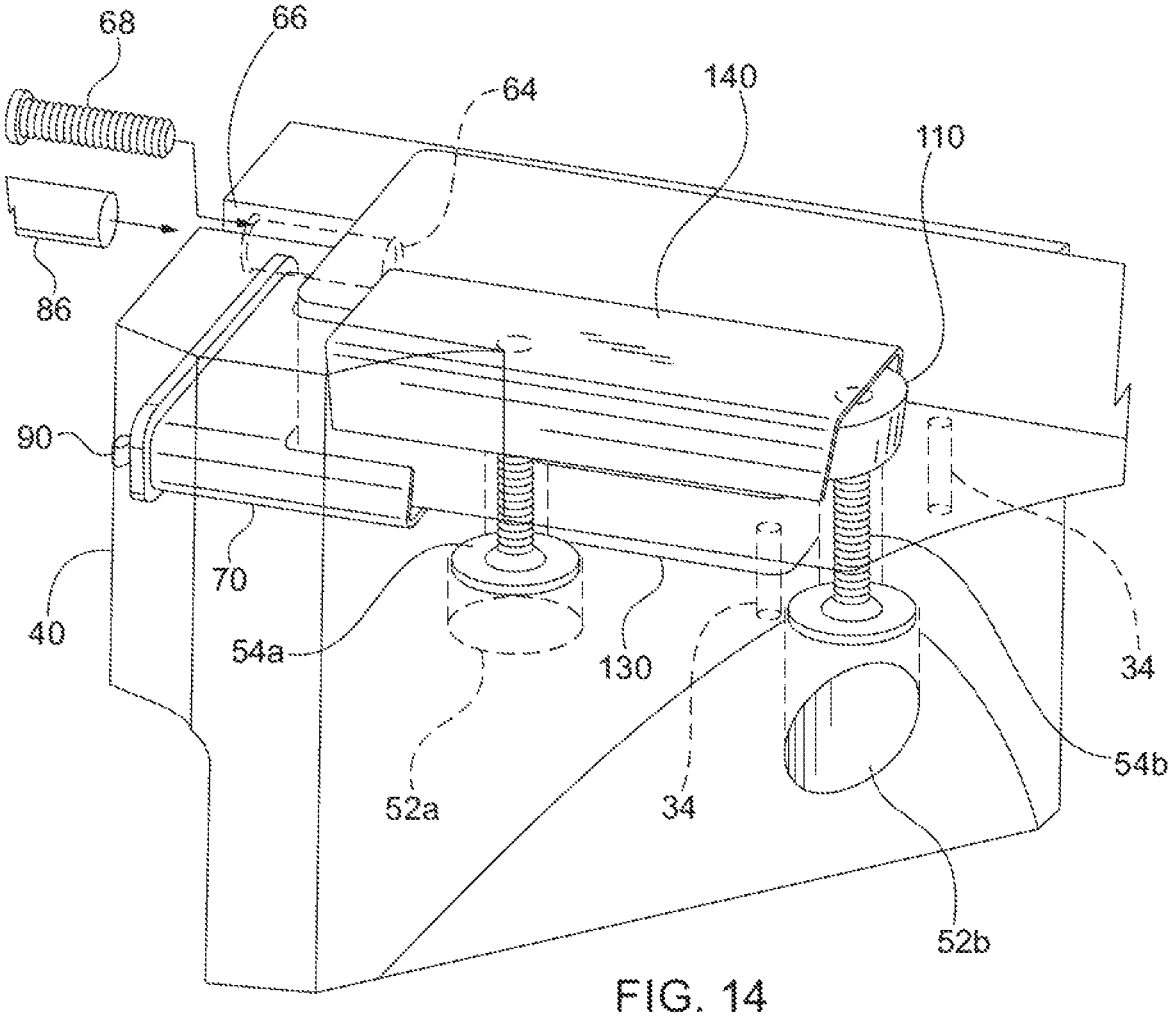
FIG. 14 depicts the shim sleeve, the shim, the dovetail key, the spring cage, and the dovetail slide of the linear dovetail neck joint in position.

The flat surface 48 also has an aperture 64 configured to receive an intonation set screw 68 (see FIG. 14). The intonation set screw 68 may have a head, as illustrated in FIG. 14, or it may be headless. The aperture 64 is preferably, although not necessarily, round and has a diameter of about 0.275 inches (0.70 cm). The aperture 64 extends completely through the rear wall 44*c* from the flat surface 48 to the open area (the "neck pocket") defined by the full side wall 44*a*, the rear wall 44*c*, the partial side wall 44*b*, the shelf 58, and the top platform 42. The user can access the intonation set screw 68 through the sound hole 28.

The process of setting intonation involves adjusting the length of the string 10 by moving the neck 4 forward or back. To shorten overall scale length and compensate for flat intonation, the user loosens the intonation set screw 68, typically with the help of a small screwdriver. To lengthen the overall scale length and compensate for sharp intonation, the user tightens the intonation set screw 68. The intonation set screw 68 moves the neck 4 relative to the block 40 (and, therefore, relative to the body 2), adjusting the distance between the saddle 14 and the nut 22 and, therefore, the intonation of the guitar 1. In this manner, the user can fine tune the intonation and the overall scale length, i.e., the vibrating length of the strings 10 of the guitar 1, using the intonation set screw 68 of the linear dovetail neck joint. The neck 4 is prevented from tilting toward the bass or treble side under string tension (i.e., side-to-side movement of the neck 4 is prevented) by the alignment pins 34 which allow for adjustment along the (linear) intonation axis while maintaining a centered position relative to the bridge 16 of the guitar 1.

The flat surface 48 also has an access 66. The access 66 is formed (typically cut) in the top of the rear wall 44*c* and, like the aperture 64, extends completely through the rear wall 44*c* from the flat surface 48 to the neck pocket. The access 66 of the block 40 is shaped to align and engage with the passage 36 in the neck 4 when the components are joined by the linear dovetail neck joint. Typically, the access 66 is U-shaped with the legs being separated by a distance of about 0.385 inches (1 cm) and having a radius of curvature of about 0.192 inches (0.5 cm). The access 66 and the passage 36 combine to receive a conventional truss rod 86 when the guitar 1 is fully assembled (see FIG. 14). The truss rod 86 is typically made of steel or titanium and has a diameter of about 0.16 inches (4 mm).

Although FIG. 4A illustrates the aperture 64 to the left of the access 66 and FIG. 4B illustrates the aperture 64 to the right of the access 66, the aperture 64 could be placed on the opposite side of the access 66. In that alternative embodiment, the aperture 64 would be illustrated to the right of the access 66 in FIG. 4A and to the left of the access 66 in FIG. 4B. The alternative embodiments could accommodate left-handed and right-handed musicians, respectively.

Noteworthy are that the neck 4 of the linear dovetail neck joint does not have a conventional heel (like the heel 26 depicted in FIG. 2) and that the block 40 of the linear dovetail neck joint has the contoured surface 46. The absence of the heel and the presence of the contoured surface 46 combine to give the user better access to the upper frets 9 of the guitar 1 than is possible with conventional acoustic instruments. The advantage is achieved of extreme fret accessibility in the upper register of the fretboard 24 even on an instrument of conventional acoustic guitar depth (3+ inches or 7.6+ cm).

The linear dovetail neck joint further includes a number of separable components in addition to the main components of the neck 4 and the block 40. Among those separable components are a shim sleeve 70, one or more shims 90, a dovetail key 110, a spring cage 130, and a dovetail slide 140. Each of the shim sleeve 70, the one or more shims 90, the dovetail key 110, the spring cage 130, and the dovetail slide 140 is a separate, solid, integral component. Each of those components are highlighted below with reference to how they interact with the neck 4, the block 40, and the other separable components.

Figure 6:
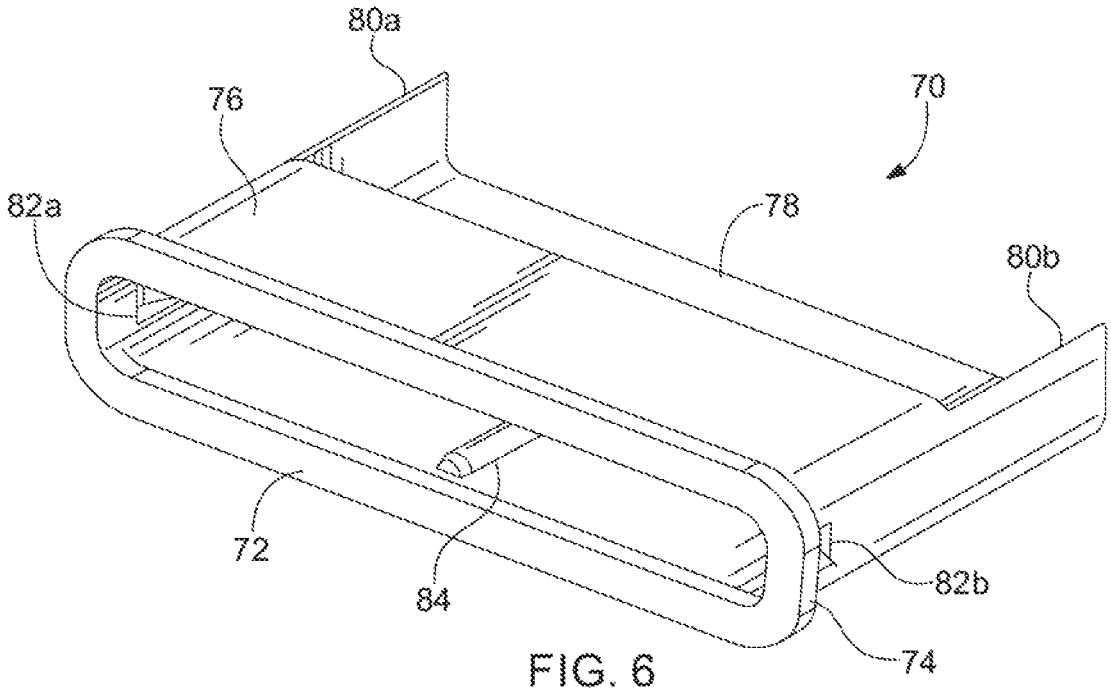
FIG. 6 is a front perspective view of an example embodiment of the shim sleeve that forms part of the linear dovetail neck joint.

The shim sleeve 70 is configured to be inserted into the window 60 formed in the flat surface 48 of the block 40. In fact, as best shown in FIG. 6, which is a front perspective view of an example embodiment of the shim sleeve 70 that forms part of the linear dovetail neck joint, the front face 72 of the shim sleeve 70 is formed by a flange 74 that sits in the notch 62 of the window 60 so that, when the shim sleeve 70 is fully inserted into the window 60, the front face 72 of the shim sleeve 70 is substantially flush with the flat surface 48 of the block 40. Thus, like the window 60, the front face 72 of the shim sleeve 70 has, for example, a substantially rectangular or oval shape of similar dimensions to the window 60. Although the shim sleeve 70 might be inserted into the window 70 via a friction fit, so that the shim sleeve 70 can be removed from the window 70 and replaced, the shim sleeve 70 is more typically affixed (e.g., glued) into position inside the window 70.

The shim sleeve 70 has a top 76, a bottom 78, and a pair of side walls 80*a* and 80*b*. The top 76 defines a flat surface that extends from the front face 72 only partially along the side walls 80*a* and 80*b*. In contrast, the bottom 78 defines a flat surface that extends from the front face 72 fully along the side walls 80*a* and 80*b*. The bottom 78 has an upstanding rib 84 formed in the center of the bottom 78. Although the rib 84 could extend the full length of the bottom 78, as illustrated in FIG. 6 the rib 84 only extends along the bottom 78 to the location under the top 76 where the top 76 terminates. Each of the side walls 80*a* and 80*b* has a respective slot 82*a* and 82*b* located near the junction between the side walls 80*a* and 80*b* and the flange 74 and a short distance behind the flange 74.

When the shim sleeve 70 is fully inserted into the window 60 of the block 40, the top 76 contacts the underside of the rear wall 44*c*, the bottom 78 contacts the shelf 58, and the side walls 80*a* and 80*b* contact the full side wall 44*a* and the partial side wall 44*b*, respectively, of the block 40. These various contact points provide suitable locations to glue the shim sleeve 70 into its fully inserted position. In that position, the bottom 78 of the shim sleeve 70 is lower than (i.e., is recessed in the shelf 58 and not flush with) the top platform 42 of the block 40 to accommodate the height of the shim 90.

The shim sleeve 70 can be made of plastic and can be either injection molded or additively manufactured using 3D printing (the term "additive manufacturing" can be used synonymously with 3D printing). The term "3D printing" covers a variety of processes in which material is joined or solidified under computer control to create a three-dimensional ("3D") object, with material being added together (such as liquid molecules or powder grains being fused together), typically layer by layer. In 3D printing, a three-dimensional object is built from a computer-aided design (CAD) model. One of the key advantages of 3D printing is the ability to produce complex shapes or geometries. In an alternative embodiment, the shim sleeve 70 can be made of a suitable metal such as stainless steel.

Figure 7:
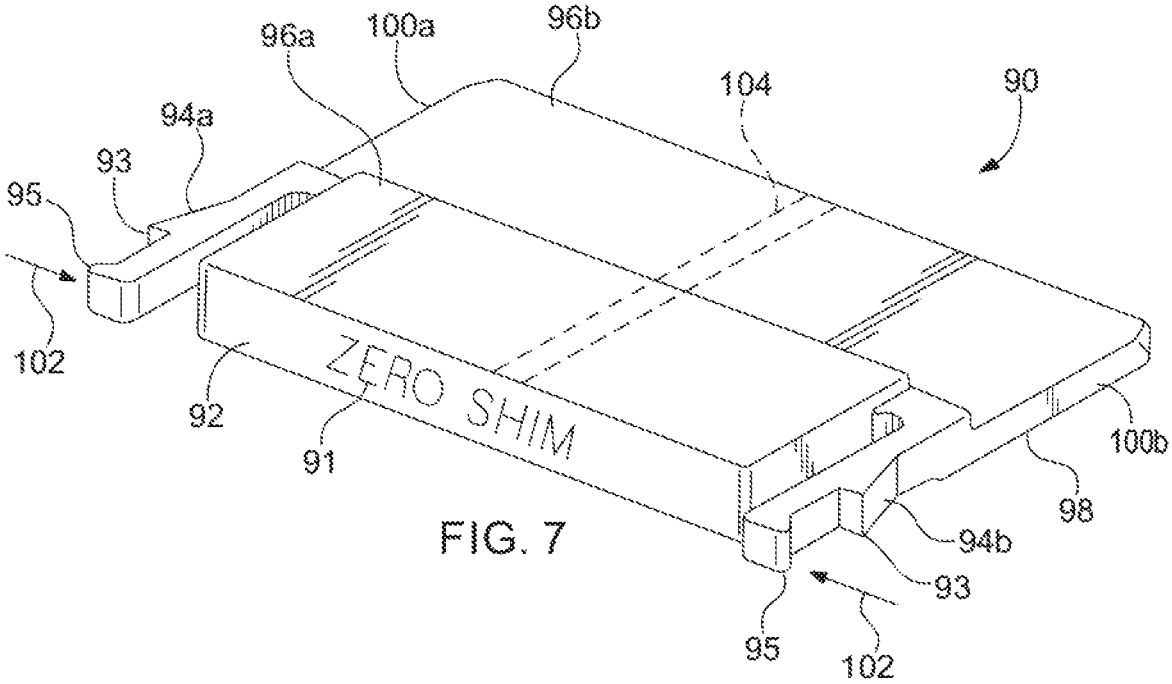
FIG. 7 is a front perspective view of an example embodiment of the shim that forms part of the linear dovetail neck joint.

FIG. 7 is a front perspective view of an example embodiment of the shim 90 that forms part of the linear dovetail neck joint. The shim 90 is configured to be inserted into the shim sleeve 70. The shim 90 can be releasably inserted into, and removed from, the shim sleeve 70. The geometry of the shim 90 is sufficiently similar to the geometry of the shim sleeve 70 that the shim 90 engages the shim sleeve 70 in a snug, friction-fit manner. The shim 90 has a front face 92 on which indicia 91 can be depicted. The indicia 91 can provide a variety of information to the user, especially including the size of the shim 90. Like the shim sleeve 70, the shim 90 can be made of plastic and can be either injection molded or additively manufactured using 3D printing.

In an alternative embodiment, the shim 90 can be made using liquid metal technology. Liquid metals are members of a series or class of amorphous (non-crystalline) metal alloys sometimes known as bulk metallic glasses because the material shares some properties most closely associated with glass. Liquid metals combine a number of desirable material features, including high tensile strength, excellent corrosion resistance, very high coefficient of restitution, and excellent anti-wear characteristics, while also being able to be heat-formed in processes similar to thermoplastics. The atomic structure of amorphous metal results in low shrinkage (0.4%) during molding and allows for the production of highly precise (±0.0008 inches or 0.02 mm), complex parts. Liquid metal is a potential replacement for many applications where plastics would normally be used. Plastics are flexible but not strong and metals, although stronger than plastics, are not as flexible. Liquid metals provide an advantageous compromise: batches of amorphous steel with three times the strength of conventional steel alloys have been produced.

The shim 90 further has a stepped top with a higher top portion 96*a* and a lower top portion 96*b*, a bottom 98, and a pair of side walls 100*a* and 100*b*. The higher top portion 96*a* of the shim 90 defines a flat surface that extends from the front face 92 only partially along the side walls 100*a* and 100*b* and is sized and shaped to engage the underside of the top 76 of the shim sleeve 70 when the shim 90 is fully inserted into the shim sleeve 70. The lower top portion 96*b* of the shim 90 defines a flat surface that extends from the end of the higher top portion 96*a* the rest of the length of the side walls 100*a* and 100*b*. The height of the lower top portion 96*b* defines both the size of the shim 90, as reflected in the indicia 91, and the distance by which the linear dovetail neck joint separates the neck 4 from the block 40 and, therefore, the body 2 of the guitar 1 (as will be discussed below).

The bottom 98 defines a flat surface that extends from the front face 92 fully along the side walls 100*a* and 100*b*. The bottom 98 has a track 104 formed (e.g., cut) in its center. As depicted by dashed lines in FIG. 7, the track 104 extends from proximate the front face 92 fully along the side walls 100*a* and 100*b*. Typically, the track 104 begins a short distance (e.g., about 0.065 inches or 1.65 mm) behind the front face 92. The track 104 is sized and shaped (with a width, for example, of about 0.1 inches or 2.5 mm) to receive the rib 84 of the shim sleeve 70 via a sliding, frictional fit. Therefore, when the user desires to insert the shim 90 into the shim sleeve 70, the user aligns the track 104 with the rib 84 and pushes the shim 90 forward into the shim sleeve 70. The rib 84 slides along the track 104 as the user continues to insert the shim 90. The engagement between the rib 84 of the shim sleeve 70 and the track 104 of the shim 90 assures proper alignment and orientation as the shim 90 is inserted and prevents the user from inserting the shim 90 into the shim sleeve 70 in an improper orientation (i.e., the engagement makes insertion substantially foolproof). Thus, the shim 90 incorporates one-way compatibility with the shim sleeve 70 to ensure that the shim 90 is only installed in the correct orientation.

Each of the side walls 100*a* and 100*b* has a respective latch 94*a* and 94*b* located proximate the junction between the side walls 100*a* and 100*b* and the front face 92. Each latch has a first projection 93, located just behind the front face 92, and a second projection 95, located just in front of the front face 92. The first projection 93 and the second projection 95 each extend laterally beyond the respective side walls 100*a*, 100*b* of the shim 90. The second projection 95 also extends beyond the front face 92, and can be grasped by a user, when the shim 90 is fully inserted into the shim sleeve 70. The second projection 95 has a plurality of ridges to facilitate grasping by the user. The latches 94*a* and 94*b* are flexible and form spring-like elements in the side walls 100*a* and 100*b*.

When the user aligns the track 104 of the shim 90 with the rib 84 of the shim sleeve 70 and pushes the shim 90 forward into the shim sleeve 70, the higher top portion 96*a* of the shim 90 slidingly engages the top 76 of the shim sleeve 70, the bottom 98 of the shim 90 slidingly engages the bottom 78 of the shim sleeve 70, the side wall 100*a* of the shim 90 slidingly engages the side wall 80*a* of the shim sleeve 70, and the side wall 100*b* of the shim 90 slidingly engages the side wall 80*b* of the shim sleeve 70. The user continues to push the shim 90 forward into the shim sleeve 70, against the friction force developed by these engagements, until the first projections 93 contact and are blocked by the front face 92 of the shim sleeve 70.

At that point, the user presses the second projections 95 toward each other and toward the center of the shim 90, in the direction of arrows 102, and against the spring force of the latches 94*a*, 94*b* (the spring force biases the latches 94*a*, 94*b* into a position parallel to the side walls 100*a*, 100*b*). Such action allows the first projections 93 to slip past the front face 92 of the shim sleeve 70 and to slide a short distance along the side walls 80*a*, 80*b* of the shim sleeve 70 until the first projections 93 reach the respective slots 82*a*, 82*b* of the side walls 80*a*, 80*b*. The first projections 93 then snap into engagement in the respective slots 82*a*, 82*b* of the side walls 80*a*, 80*b*, driven by the spring force against the direction of arrows 102, so that the latches 94*a*, 94*b* return to their position parallel to the side walls 100*a*, 100*b* and the first projections 93 extend through the slots 82*a*, 82*b* and "catch" on the side walls 80*a*, 80*b*. That catch prevents removal of the shim 90 from the shim sleeve 70 until and unless the user desires to remove the shim 90.

Figure 8:
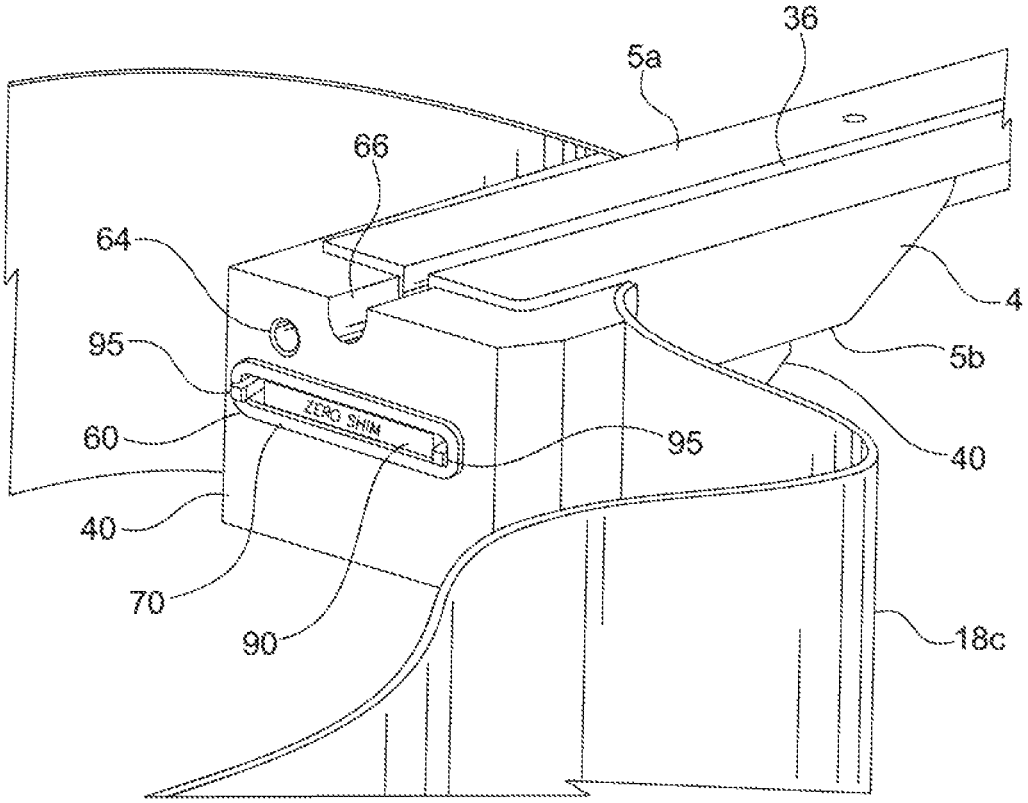
FIG. 8 is a perspective view of the linear dovetail neck joint with the shim fully seated in the shim sleeve.

The snap engagement creates both an audible "click" and a tactile acknowledgment perceptible to the user, each advising the user that the shim 90 is fully seated in its position and secured within the shim sleeve 70. In that position, as depicted in FIG. 8, which is a perspective view of the linear dovetail neck joint with the shim 90 fully seated in the shim sleeve 70, the front face 92 of the shim 90 is substantially flush with the front face 72 of the shim sleeve 70 and the second projections 95 of the shim 90 extend a short distance beyond the front face 72 of the shim sleeve 70; that distance is sufficient to allow the user to contact the second projections 95 when the user desires to remove the shim 90 from the shim sleeve 70. To achieve removal, which may be desired when the user wants to replace one shim 90 having a lower top portion 96*b* of a first height with another shim 90 having a lower top portion 96*b* of a different, second height, the user again presses the second projections 95 toward each other and toward the center of the shim 90, in the direction of arrows 102, while simultaneously pulling on the second projections 95. Those actions combine to release the first projections 93 from engagement in the respective slots 82*a*, 82*b* of the side walls 80*a*, 80*b* and slide the shim 90 out of the shim sleeve 70.

As noted above, the height of the lower top portion 96*b* of the shim 90 defines the distance which by the linear dovetail neck joint separates the end of the neck 4 from the bottom surface of the neck pocket contained within the block 40 and, therefore, defines the angle between the neck 4 and the body 2 of the guitar 1. Specifically, the leading edge of the bottom surface 5*b* of the neck 4 rests on the lower top portion 96*b* of the shim 90 when the linear dovetail neck joint is fully assembled. The minimal height of the lower top portion 96*b* of the shim 90, which may be identified as the "zero" height, places the lower top portion 96*b* of the shim 90 substantially flush or even with the top platform 42 of the block 40 when the shim 90 is fully inserted into the shim sleeve 70 and against the top platform 42. Thus, for a shim 90 of "zero" height, the bottom surface 5*b* of the neck 4 rests on both the lower top portion 96*b* of the shim 90 and on the top platform 42 of the block 40.

The lower top portion 96*b* of the shim 90 can have any desired height, however, and it is envisioned that the user will have on hand (perhaps having purchased a pack of shims 90) a plurality of different-sized shims 90, each having a lower top portion 96*b* with a different height. Thus, the lower top portion 96*b* of the shim 90 might have a height such that the lower top portion 96*b* extends above the top platform 42 of the block 40 when the shim 90 is fully inserted into the shim sleeve 70 and against the top platform 42 by a distance of zero, 0.025 inches (0.6 mm), 0.04 inches (1 mm), or any other suitable distance within the knowledge of an artisan. The indicia 91 for these example shims 90 might be, of course, "Zero Shim," "0.025 Inch Shim," and "0.040 Inch Shim," respectively. The indicia 91 for these example shims 90 also might be "Zero," "0.025 Inch," and "0.040 Inch," respectively. For a shim 90 of any height other than the "zero" height, the bottom surface 5*b* of the neck 4 rests on only the lower top portion 96*b* of the shim 90 and not on (because above) the top platform 42 of the block 40.

When a shim 90 having a height greater than the "zero" shim is used, the string action is brought closer to the frets 9. The result is that playability can be tailored to the preference of the user. The interchangeable neck-elevating shims 90 allow for a range of neck height adjustments depending on player preferences directed to string height (guitar action). The neck-elevating shims 90 permit adjustment to taste, because they will be produced in varying heights, based on optimized stringed instrument action settings.

The shims 90 may be substantially flat or wedge-shaped to correspond with various neck angles. The linear dovetail neck joint can accept or accommodate a plurality of shim heights, such as three different shim heights, six different shim heights, or some other suitable number of shim heights. Although some conventional designs require two, separate surfaces to be shimmed, only one surface makes use of the interchangeable shims 90 in the linear dovetail neck joint.

Figure 9:
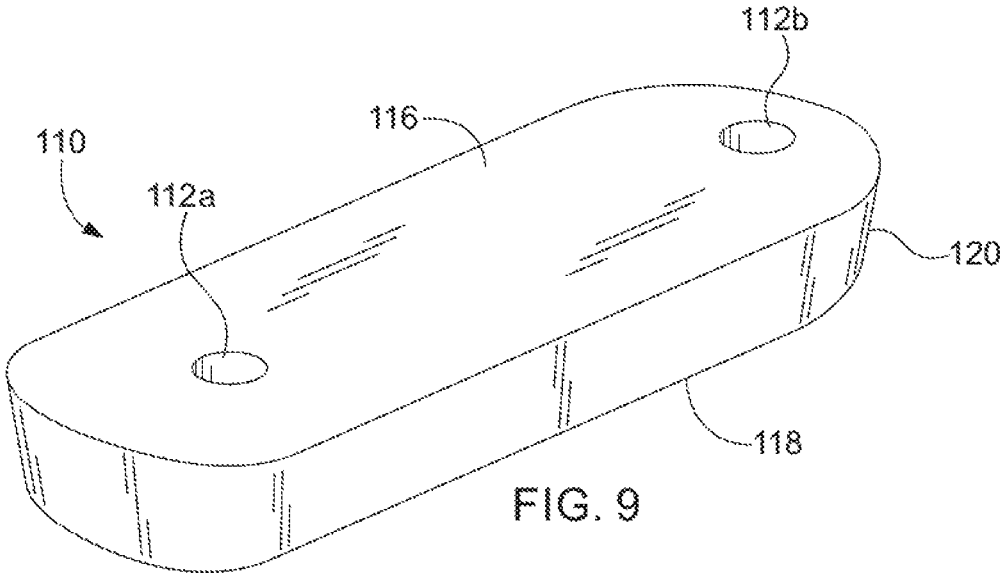
FIG. 9 is a front perspective view of an example embodiment of the dovetail key that forms part of the linear dovetail neck joint.

FIG. 9 is a front perspective view of an example embodiment of the dovetail key 110 that forms part of the linear dovetail neck joint. Preferably, the dovetail key 110 is made of metal. The example embodiment of the dovetail key 110 has a top 116, a bottom 118, and a side 120 between the top 116 and the bottom 118. The edges between the top 116 and the side 120 and between the bottom 118 and the side 120 may, or may not, be beveled. The dovetail key 110 can have any one of a number of suitable shapes; for example, the substantially rectangular or oval shape (with the side 120 having four radii of curvature) illustrated in FIG. 9 works well. Suitable dimensions for the dovetail key 110 are a length of about 2.625 inches (6.67 cm), a width of about 0.95 inches (2.41 cm), and a height of about 0.350 inches (0.90 cm). Preferably, the dovetail key 110 is trapezoidal in cross section.

Figure 10:
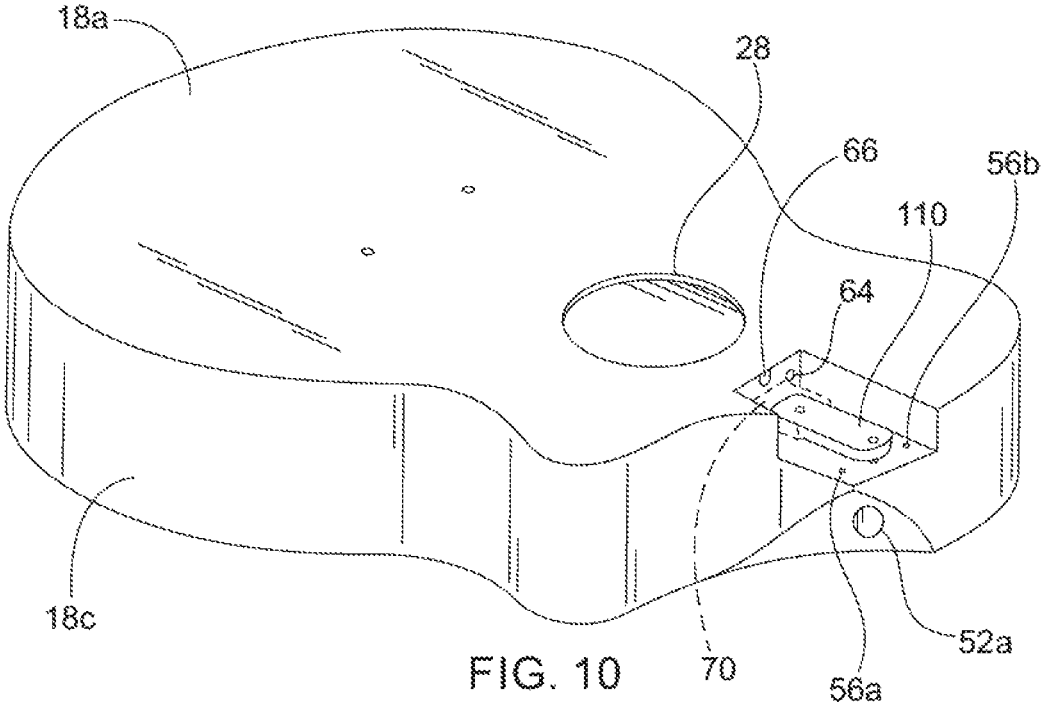
FIG. 10 depicts the dovetail key attached to the block.
Figure 12:
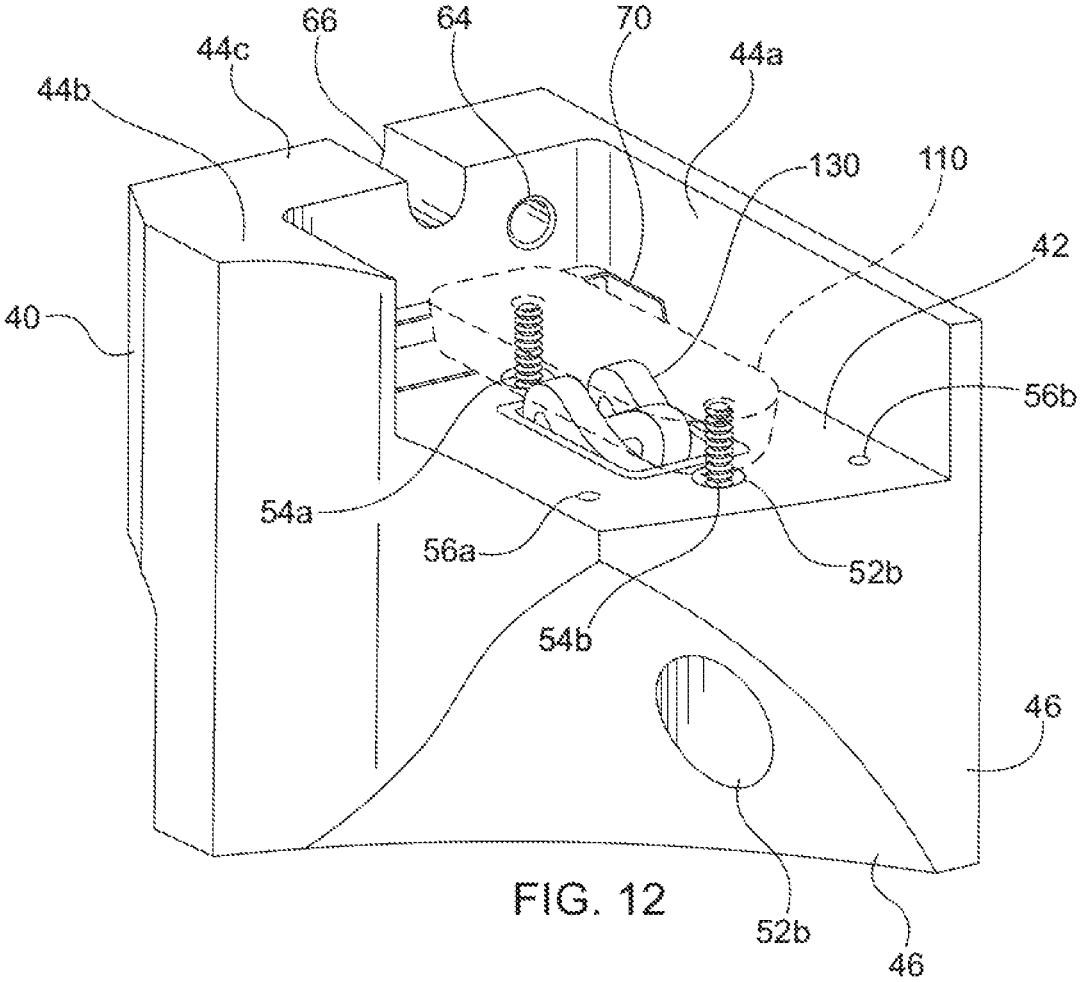
FIG. 12 illustrates the spring cage in position in the recess of the top platform of the block.

The dovetail key 110 has two, threaded openings: a first opening 112*a* and a second opening 112*b*. The first opening 112*a* and the second opening 112*b* are aligned along the central longitudinal axis of the dovetail key 110 and are positioned in the center of the width of the dovetail key 110, and each extends completely through the height of the dovetail key 110 from the top 116 to the bottom 118. The first opening 112*a* is configured to align with the first hole 52*a* in the block 40 when the dovetail key 110 is attached to the block 40; the second opening 112*b* is configured to align with the second hole 52*b* in the block 40 when the dovetail key 110 is attached to the block 40. The dovetail key 110 is attached to the block 40 using the threaded bolts 54*a* and 54*b*, as depicted in FIGS. 10, 12, and 14.

More specifically, the threaded bolt 54*a* is inserted through the first hole 52*a* in the block 40 until the threaded bolt 54*a* extends upward a distance above the top platform 42 of the block 40. The threaded bolt 54*b* similarly is inserted through the second hole 52*b* in the block 40 until the threaded bolt 54*b* extends upward a distance above the top platform 42 of the block 40. The dovetail key 110 is then positioned above the top platform 42 so that the first opening 112*a* is aligned with the first hole 52*a* and receives the threaded bolt 54*a* while the second opening 112*b* is aligned with the second hole 52*b* and receives the threaded bolt 54*b*. Rotation of the threaded bolts 54*a*, 54*b* in the corresponding threaded first and second openings 112*a*, 112*b* causes the threaded bolts 54*a*, 54*b* to pull the dovetail key 110 downward toward the top platform 42 and attaches the dovetail key 110 to the block 40. As noted above, the user can apply a conventional tool (such as an Allen wrench) to engage a slot in the head of each of the threaded bolts 54*a*, 54*b* and rotate the threaded bolts 54*a*, 54*b*.

Figure 11:
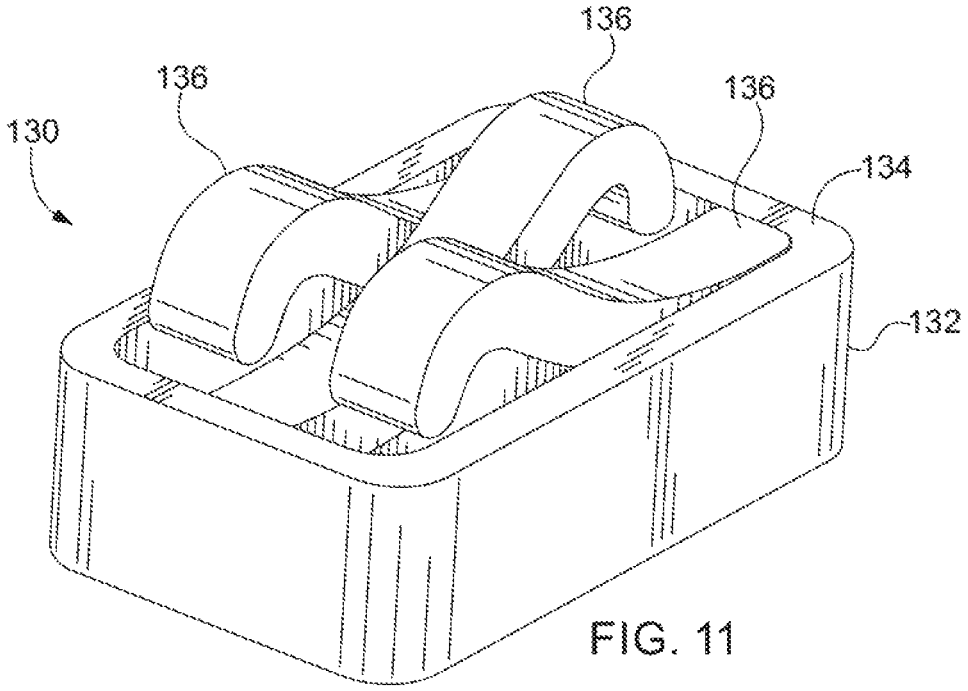
FIG. 11 is a front perspective view of an example embodiment of the spring cage that forms part of the linear dovetail neck joint.

FIG. 11 is a front perspective view of an example embodiment of the spring cage 130 that forms part of the linear dovetail neck joint. The example embodiment of the spring cage 130 has a substantially rectangular base 132 that defines a top planar surface 134. A plurality of springs 136, each integral with the base 132, extend upward above the planar surface 134 of the base 132 an equal amount. The spring cage 130 is sized and shaped (i.e., configured) to fit snugly and with a friction fit in the recess 50 of the top platform 42 of the block 40. Although not required, the spring cage 130 can be affixed (e.g., glued) to the block 40. FIG. 12 illustrates the spring cage 130 in position in the recess 50 of the top platform 42 of the block 40.

The function of the springs 136 of the spring cage 130 is to push upward against the bottom 118 of the dovetail key 110 (i.e., provide lift to the dovetail key 110) when the dovetail key 110 is pulled downward toward the top platform 42 under the action of the threaded bolts 54*a*, 54*b*. This upward force also facilitates release of the neck joint when desired. The force of the springs 136 against the bottom 118 of the dovetail key 110 must be distributed substantially equally and symmetrically, so that the force is both balanced and distributed against the dovetail key 110, and the springs 136 must provide sufficient upward resistance to fix the dovetail key 110 in position against the downward pull of the threaded bolts 54*a* and 54*b*. A single spring 136 is, and two springs 136 are, insufficient to meet these requirements. In contrast, the three springs 136 of the preferred embodiment of the spring cage 130 function well, with one of the three springs 136 facing a first longitudinal direction and the other two springs 136 facing in the opposite longitudinal direction. The spring cage 130 can be made of plastic and can be additively manufactured using 3D printing. In an alternative embodiment, the spring cage 130 can be made using liquid metal technology.

Figure 13:
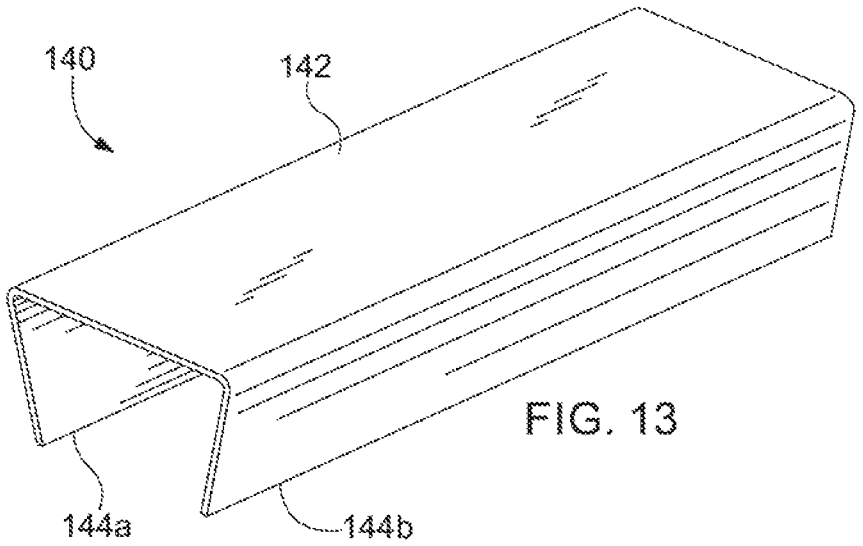
FIG. 13 is a front perspective view of an example embodiment of the dovetail slide that forms part of the linear dovetail neck joint.

FIG. 13 is a front perspective view of an example embodiment of the dovetail slide 140 that forms part of the linear dovetail neck joint. The example embodiment of the dovetail slide 140 has a head 142 and two legs 144*a* and 144*b*. The dovetail slide 140 is sized and shaped (i.e., configured) to fit snugly within the mortise 30 in the neck 4. Thus, like the mortise 30, the dovetail slide 140 is preferably although not necessarily trapezoidal in cross section and rectangular in shape. The legs 144*a* and 144*b* of the dovetail slide 140 may be formed at an angle of about 28 degrees from vertical. The width, length, and height of the dovetail slide 140 are substantially the same as the corresponding dimensions of the mortise 30. The dovetail slide 140 may be held in the mortise 30 via a fiction fit or may be affixed (e.g., glued) in the mortise 30. One function of the dovetail slide 140 is to reinforce the mortise 30, thereby reducing the risk of cracks in the neck 4 which might be caused by downward pressure from the dovetail key 110.

Another function of the dovetail slide 140 is to facilitate movement between the neck 4 and the block 40. More specifically, the dovetail slide 140 forms a guide in the mortise 30 of the neck 4. The dovetail key 110 engages (i.e., slides into) the dovetail slide 140 when the user affixes the neck 4 to the block 40, as shown in FIG. 14. (FIG. 14 also depicts the shim sleeve 70, the shim 90, and the spring cage 130 of the linear dovetail neck joint in position.) The dovetail slide 140 minimizes the friction that might otherwise restrict the sliding motion of the dovetail key 110 into the mortise 30. The dovetail slide 140 may be made out of metal (which is preferred, especially if the dovetail key 110 is made of metal) or a plastic material such as polypropylene. The dovetail slide 140 is made of a different material (even if both are metals) than the dovetail key 110, however, to prevent galling between the two mating surfaces. The dovetail slide 140 could be lubricated to facilitate movement of the neck 4 in the block 40. With a self-gliding material such as metal or polypropylene, however, lubrication is unnecessary to provide a surface that is optimal for the movement of the neck 4 relative to the block 40.

With the dovetail key 110 inserted into the dovetail slide 140 (and, hence, into the mortise 30 of the neck 4), the user can tighten the bolts 54*a* and 54*b* from outside the guitar 1 and thereby draw the dovetail key 110 downward toward the block 40 against the upward force of the spring cage 130. Such action simultaneously draws the neck 4 downward into engagement with the block 40 and the body 2 of the guitar 1. The user continues to tighten the bolts 54*a* and 54*b* until the neck 4 is drawn tightly and securely into position in the block 40. The neck 4 indexes on the alignment pins 34 as tightening occurs. The reverse action (i.e., loosening the bolts 54*a* and 54*b*) separates the neck 4 from the body 2 and, ultimately, allows removal of the neck 4 from the body 2. The upward force of the spring cage 130 facilitates such separation and removal.

The linear dovetail neck joint allows the user to change the height between the neck 4 and the body 2, the angle between those instrument components, or both. The two bolts 54*a* and 54*b* that engage the dovetail key 110 might suggest that adjusting one of the bolts (e.g., the bolt 54*a*) an amount different from the other bolt (e.g., the bolt 54*b*) might affect the angle. The user must tighten both of the bolts 54*a* and 54*b* the same torque setting, however, to have the neck 4 and the body 2 join properly.

Thus, the linear dovetail neck joint functions to fasten the neck 4 to the body 2 of the guitar 1 using an internal dovetail with screw-adjustable tension. There are no bolts or permanent adhesives directly binding the neck 4 to the body 2. In fact, no fasteners or threaded inserts directly enter or are screwed into the neck 4. The neck 4 is fastened to the body 2 through indirect coupling while the linear dovetail neck joint applies even, adjustable, downward tension on the neck 4. The linear dovetail neck joint does not require removal of the neck 4 from the block 40 to adjust the position of the neck 4 relative to the body 2 of the guitar 1. The neck 4 can be removed from the body 2 using the linear dovetail neck joint, however, allowing the user to adjust or replace the neck 4. The linear dovetail neck joint permits the user to interchange necks 4 of the guitar 1 easily.

Furthermore, conventional designs require the neck 4 to be fully removed from the body 2 to access shims for neck adjustment. With the linear dovetail neck joint, the shims 90 can be interchanged simply by loosening the linear dovetail neck joint and clicking an alternate shim 90 into place as desired. This feature is much more convenient for manufacturing and for the end consumer. In production, this feature permits one uniform size of stringed instrument bridge 16 and saddle 14 versus the conventional combination of several (e.g., three) different bridges and many (e.g., five) different saddle heights to achieve the correct geometry. Now the correct geometry can be reliably established at the neck joint through the use of the shims 90 without requiring repeated disassembly.

The linear dovetail neck joint allows for extreme fret accessibility in the upper register of the fretboard 24, easier neck adjustments, intonation correction, and unique front block configurations with hand relief all without the need for adhesives. It permits a practical and aesthetically pleasing neck-to-body joint without the need for a heel 26 on the neck 4. The result is a neck-to-body joint that is easily playable, adjustable, and serviceable.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed:

1. A linear dovetail neck joint for a musical instrument having a body, the linear dovetail neck joint comprising:

a neck having a bottom surface with a mortise;

a block having a contoured surface that forms part of the body when the block is fastened to the body, a top platform with a hole that is accessible from outside the musical instrument and is configured to receive a fastener, and a rear surface with a window;

a shim sleeve configured to be inserted into the window in the block;

at least one substantially flat or angled shim configured to be inserted into the shim sleeve, the shim having a top portion with a height that defines the distance by which the linear dovetail neck joint separates the neck from the block as the bottom surface of the neck rests on the top portion when the linear dovetail neck joint is fully assembled; and a dovetail key engaging at least indirectly the mortise of the neck and having a top, a bottom, and an opening extending through the dovetail key from the top to the bottom, wherein the opening is aligned with the hole of the block and is configured to receive the fastener, and wherein rotation of the fastener in the opening causes the fastener to pull the dovetail key downward along with the neck toward the top platform of the block and attaches the dovetail key and the neck to the block.

2. The linear dovetail neck joint according to claim 1 wherein the linear dovetail neck joint is devoid of any screws that go directly into the neck or a heel on the neck.

3. A musical instrument comprising the linear dovetail neck joint according to claim 1.

4. The musical instrument according to claim 3, wherein the musical instrument is a guitar.

5. The linear dovetail neck joint according to claim 1 wherein the top platform of the block has a recess and the linear dovetail neck joint further comprises a spring cage having a base with a top planar surface, the base configured to fit snugly in the recess of the top platform of the block, and a plurality of springs extending upward above the planar surface of the base and applying an upward force against the bottom of the dovetail key to fix the dovetail key in position against the downward pull of the fastener.

6. The linear dovetail neck joint according to claim 1 further comprising a dovetail slide configured to fit snugly within and reinforce the mortise in the neck, the dovetail slide engaging the dovetail key when the neck is attached to the block and facilitating movement between the neck and the block.

7. The linear dovetail neck joint according to claim 1 wherein the rear surface of the block has an aperture and the linear dovetail neck joint further comprises an intonation set screw received in the aperture for moving the neck relative to the body and adjusting the intonation of the musical instrument.

8. The linear dovetail neck joint according to claim 1 wherein the bottom surface of the neck has at least two slots and the top platform of the block has at least two alignment orifices with one alignment orifice aligned with and corresponding to each one of the at least two slots in the bottom surface of the neck when the linear dovetail neck joint is fully assembled, and the linear dovetail neck joint further comprises at least two alignment pins, one alignment pin inserted partially into each one of the at least two alignment orifices in the top platform of the block and into the aligned and corresponding one of the at least two slots in the bottom surface of the neck when the linear dovetail neck joint is fully assembled, the alignment pins aligning the neck with the block and preventing side-to-side movement of the neck.

9. The linear dovetail neck joint according to claim 1 wherein the neck has a top surface with a passage configured to receive a truss rod and the block has an access aligned with the passage in the top surface of the neck and configured to receive the truss rod.

10. The linear dovetail neck joint according to claim 1 wherein the body has a third hole, the block has an underside, and the top platform of the block has a second hole that extends from the top platform through the underside, aligns with the third hole in the body, is accessible from outside the musical instrument, and is configured to receive a second fastener.

11. The linear dovetail neck joint according to claim 10 wherein the dovetail key has a second opening extending through the dovetail key from the top to the bottom and a central longitudinal axis along which the opening and the second opening each are aligned, wherein the second opening is aligned with the second hole of the block and is configured to receive the second fastener, and wherein rotation of the second fastener in the corresponding second opening causes the second fastener to pull the dovetail key downward toward the top platform of the block and attaches the dovetail key to the block.

12. The linear dovetail neck joint according to claim 1 wherein the shim sleeve has a front face, a bottom with an upstanding rib, and side walls each with a respective slot.

13. The linear dovetail neck joint according to claim 12 wherein the at least one substantially flat or angled shim is configured to engage the shim sleeve in a snug friction-fit manner, the shim having a bottom with a track configured to receive the rib of the shim sleeve and side walls each with a respective flexible and spring-like latch including a first projection configured to snap into engagement in the respective slots of the side walls of the shim sleeve when the shim is fully seated in the shim sleeve and a second projection that extends a short distance beyond the front face of the shim sleeve when the shim is fully seated in the shim sleeve.

14. The linear dovetail neck joint according to claim 1 wherein the musical instrument has a nut, a saddle, and a linear distance between the nut and saddle and the linear dovetail neck joint is configured to adjust the linear distance between the nut and saddle without any change in the angle of the neck relative to the body.

15. The linear dovetail neck joint according to claim 1 wherein the block is made of wood.

16. The linear dovetail neck joint according to claim 1 further comprising multiple shims each having a different size.

17. The linear dovetail neck joint according to claim 16 wherein each of the multiple shims depicts indicia indicating the size of the shim.

18. A linear dovetail neck joint for a musical instrument with a body having a rear plate with a third hole, the linear dovetail neck joint comprising:

a neck having a top surface with a passage configured to receive a truss rod and a bottom surface with a mortise and at least two slots;

an intonation set screw for moving the neck relative to the body and adjusting the intonation of the musical instrument;

a block having (i) a contoured surface that forms part of the body when the block is fastened to the body, (ii) an underside, (iii) a top platform with a recess, a first hole that extends from the top platform through the underside and aligns with the third hole in the rear plate of the body and is accessible from outside the musical instrument and is configured to receive a first fastener, a second hole that extends from the top platform through the contoured surface and is accessible outside the musical instrument and is configured to receive a second fastener, and at least two alignment orifices with one alignment orifice aligned with and corresponding to each one of the at least two slots in the bottom surface of the neck when the linear dovetail neck joint is fully assembled, and (iv) a rear surface with a window, an aperture configured to receive the intonation set screw, and an access aligned with the passage in the top surface of the neck and configured to receive the truss rod;

at least two alignment pins, one alignment pin inserted partially into each one of the at least two alignment orifices in the top platform of the block and into the aligned and corresponding one of the at least two slots in the bottom surface of the neck when the linear dovetail neck joint is fully assembled, the alignment pins aligning the neck with the block and preventing side-to-side movement of the neck;

a shim sleeve configured to be inserted into the window in the block, the shim sleeve having a front face, a bottom with an upstanding rib, and side walls each with a respective slot;

at least one substantially flat or angled shim configured to be inserted into the shim sleeve and to engage the shim sleeve in a snug friction-fit manner, the shim having a top portion with a height that defines the distance by which the linear dovetail neck joint separates the neck from the body as the bottom surface of the neck rests on the top portion when the linear dovetail neck joint is fully assembled, a bottom with a track configured to receive the rib of the shim sleeve, and side walls each with a respective flexible and spring-like latch including a first projection configured to snap into engagement in the respective slots of the side walls of the shim sleeve when the shim is fully seated in the shim sleeve and a second projection that extends a short distance beyond the front face of the shim sleeve when the shim is fully seated in the shim sleeve;

a dovetail key having a top, a bottom, and a central longitudinal axis with a first opening and a second opening each aligned along the axis and extending through the dovetail key from the top to the bottom, wherein the first opening is aligned with the first hole of the block and is configured to receive the first fastener and the second opening is aligned with the second hole of the block and is configured to receive the second fastener, and wherein rotation of the first and second fasteners in the corresponding first and second openings causes the fasteners to pull the dovetail key downward toward the top platform of the block and attaches the dovetail key to the block;

a spring cage having a base with a top planar surface, the base configured to fit snugly in the recess of the top platform of the block, and a plurality of springs extending upward above the planar surface of the base and applying an upward force against the bottom of the dovetail key to fix the dovetail key in position against the downward pull of the fasteners; and a dovetail slide configured to fit snugly within and reinforce the mortise in the neck, the dovetail slide engaging the dovetail key when the neck is affixed to the block and facilitating movement between the neck and the block.

19. A musical instrument comprising the linear dovetail neck joint according to claim 18.

20. The musical instrument according to claim 19, wherein the musical instrument is a guitar.

* * * * *